US008893811B2

(12) United States Patent
Miller

(10) Patent No.: US 8,893,811 B2
(45) Date of Patent: Nov. 25, 2014

(54) RESPONSIVELY ACTIVATED WELLBORE STIMULATION ASSEMBLIES AND METHODS OF USING THE SAME

(75) Inventor: Brock Miller, Calgary (CA)

(73) Assignee: Halliburton Energy Services, Inc., Duncan, OK (US)

( * ) Notice: Subject to any disclaimer, the term of this patent is extended or adjusted under 35 U.S.C. 154(b) by 692 days.

(21) Appl. No.: 13/156,155

(22) Filed: Jun. 8, 2011

(65) Prior Publication Data

US 2012/0312547 A1 Dec. 13, 2012

(51) Int. Cl.

| | |
|---|---|
| ***E21B 34/06*** | (2006.01) |
| ***E21B 43/26*** | (2006.01) |
| ***E21B 34/10*** | (2006.01) |
| ***E21B 34/14*** | (2006.01) |
| *E21B 34/00* | (2006.01) |

(52) U.S. Cl.

CPC ..... *E21B 43/26* (2013.01); *E21B 2034/007* (2013.01); *E21B 34/10* (2013.01); *E21B 34/14* (2013.01)

USPC ..... 166/386; 166/318; 166/375; 166/332.4; 137/614.11

(58) Field of Classification Search

CPC ... E21B 34/14; E21B 43/14; E21B 2034/007; E21B 43/12; E21B 43/162

USPC ..... 166/386, 318, 373–375, 332.1, 332.4, 166/332.7, 334.1, 334.4; 137/614.11; 251/57

See application file for complete search history.

(56) References Cited

U.S. PATENT DOCUMENTS

| | | | |
|---|---|---|---|
| 2,201,290 | A | 5/1940 | Greene |
| 2,493,650 | A | 1/1950 | Baker et al. |
| 2,537,066 | A | 1/1951 | Lewis |
| 2,627,314 | A | 2/1953 | Baker et al. |
| 2,913,051 | A | 11/1959 | Lister |
| 3,054,415 | A | 9/1962 | Baker et al. |
| 3,057,405 | A | 10/1962 | Mallinger |
| 3,151,681 | A | 10/1964 | Cochran |

(Continued)

FOREIGN PATENT DOCUMENTS

| | | | |
|---|---|---|---|
| AU | 2012200380 | A1 | 2/2012 |
| CA | 2778311 | A1 | 5/2011 |

(Continued)

OTHER PUBLICATIONS

Foreign communication from a related counterpart application—International Search Report and Written Opinion, PCT/GB2012/000140, May 30, 2012, 11 pages.

(Continued)

*Primary Examiner* — William P Neuder
*Assistant Examiner* — Kipp Wallace
(74) *Attorney, Agent, or Firm* — John Wustenberg; Conley Rose, P.C.

(57) ABSTRACT

A system for servicing a subterranean formation comprising a wellbore completion string comprising a first master activatable stimulation assembly, a first slave activatable stimulation assembly, wherein the first slave activatable stimulation assembly activates responsive to activation of the first master stimulation assembly; a second master activatable stimulation assembly, and a second slave activatable stimulation assembly, wherein the second slave activatable stimulation assembly activates responsive to activation of the second master stimulation assembly.

20 Claims, 5 Drawing Sheets

(56) References Cited

U.S. PATENT DOCUMENTS

| | | | |
|---|---|---|---|
| 3,216,497 | A | 11/1965 | Howard et al. |
| 3,295,607 | A | 1/1967 | Sutliff |
| 3,363,696 | A | 1/1968 | Berryman |
| 3,434,537 | A | 3/1969 | Zandmer |
| 3,662,825 | A | 5/1972 | Nutter |
| 3,662,826 | A | 5/1972 | Young et al. |
| 3,768,556 | A | 10/1973 | Baker |
| 3,850,238 | A | 11/1974 | Hill |
| 4,047,564 | A | 9/1977 | Nix et al. |
| 4,081,990 | A | 4/1978 | Chatagnier |
| 4,105,069 | A | 8/1978 | Baker |
| 4,109,725 | A | 8/1978 | Williamson et al. |
| 4,150,994 | A | 4/1979 | Maternaghan |
| 4,196,782 | A | 4/1980 | Blanton |
| 4,373,582 | A | 2/1983 | Bednar et al. |
| 4,417,622 | A | 11/1983 | Hyde |
| 4,469,136 | A | 9/1984 | Watkins |
| 4,605,074 | A | 8/1986 | Barfield |
| 4,673,039 | A | 6/1987 | Mohaupt |
| 4,691,779 | A | 9/1987 | McMahan et al. |
| 4,714,117 | A | 12/1987 | Dech |
| 4,771,831 | A | 9/1988 | Pringle et al. |
| 4,842,062 | A | 6/1989 | Schneider et al. |
| 4,893,678 | A | 1/1990 | Stokley et al. |
| 5,125,582 | A | 6/1992 | Surjaatmadja et al. |
| 5,127,472 | A | 7/1992 | Watson et al. |
| 5,137,086 | A | 8/1992 | Stokley et al. |
| 5,156,220 | A | 10/1992 | Forehand et al. |
| 5,180,016 | A | 1/1993 | Ross et al. |
| 5,193,621 | A | 3/1993 | Manke et al. |
| 5,289,875 | A | 3/1994 | Stokley et al. |
| 5,314,032 | A | 5/1994 | Pringle et al. |
| 5,323,856 | A | 6/1994 | Davis et al. |
| 5,325,917 | A | 7/1994 | Szarka |
| 5,325,923 | A | 7/1994 | Surjaatmadja et al. |
| 5,361,856 | A | 11/1994 | Surjaatmadja et al. |
| 5,366,015 | A | 11/1994 | Surjaatmadja et al. |
| 5,375,662 | A | 12/1994 | Echols, III et al. |
| 5,381,862 | A | 1/1995 | Szarka et al. |
| 5,396,957 | A | 3/1995 | Surjaatmadja et al. |
| 5,425,424 | A | 6/1995 | Reinhardt et al. |
| 5,484,016 | A | 1/1996 | Surjaatmadja et al. |
| 5,494,103 | A | 2/1996 | Surjaatmadja et al. |
| 5,494,107 | A | 2/1996 | Bode |
| 5,499,678 | A | 3/1996 | Surjaatmadja et al. |
| 5,499,687 | A | 3/1996 | Lee |
| 5,533,571 | A | 7/1996 | Surjaatmadja et al. |
| 5,558,153 | A | 9/1996 | Holcombe et al. |
| 5,732,776 | A | 3/1998 | Tubel et al. |
| 5,765,642 | A | 6/1998 | Surjaatmadja |
| 5,826,661 | A | 10/1998 | Parker et al. |
| 5,865,252 | A | 2/1999 | Van Petegem et al. |
| 5,865,254 | A | 2/1999 | Huber et al. |
| 5,927,401 | A | 7/1999 | Morris et al. |
| 5,944,105 | A | 8/1999 | Nguyen |
| 5,947,198 | A | 9/1999 | McKee et al. |
| 5,947,205 | A | 9/1999 | Shy |
| 5,960,881 | A | 10/1999 | Allamon et al. |
| 6,000,468 | A | 12/1999 | Pringle |
| 6,003,834 | A | 12/1999 | Read |
| 6,006,838 | A | 12/1999 | Whiteley et al. |
| 6,041,864 | A | 3/2000 | Patel et al. |
| 6,116,343 | A | 9/2000 | Van Petegem et al. |
| 6,119,783 | A | 9/2000 | Parker et al. |
| 6,145,593 | A | 11/2000 | Hennig |
| 6,152,232 | A | 11/2000 | Webb et al. |
| 6,167,974 | B1 | 1/2001 | Webb |
| 6,189,618 | B1 | 2/2001 | Beeman et al. |
| 6,216,785 | B1 | 4/2001 | Achee, Jr. et al. |
| 6,230,811 | B1 | 5/2001 | Ringgenberg et al. |
| 6,241,015 | B1 | 6/2001 | Pringle et al. |
| 6,244,342 | B1 | 6/2001 | Sullaway et al. |
| 6,253,861 | B1 | 7/2001 | Carmichael et al. |
| 6,257,339 | B1 | 7/2001 | Haugen et al. |
| 6,286,599 | B1 | 9/2001 | Surjaatmadja et al. |
| 6,318,469 | B1 | 11/2001 | Patel |
| 6,318,470 | B1 | 11/2001 | Chang et al. |
| 6,336,502 | B1 | 1/2002 | Surjaatmadja et al. |
| 6,343,658 | B2 | 2/2002 | Webb |
| 6,359,569 | B2 | 3/2002 | Beck et al. |
| 6,422,317 | B1 | 7/2002 | Williamson, Jr. |
| 6,467,541 | B1 | 10/2002 | Wells |
| 6,494,264 | B2 | 12/2002 | Pringle et al. |
| 6,520,257 | B2 | 2/2003 | Allamon et al. |
| 6,543,538 | B2 | 4/2003 | Tolman et al. |
| 6,561,277 | B2 | 5/2003 | Algeroy et al. |
| 6,571,875 | B2 | 6/2003 | Bissonnette et al. |
| 6,634,428 | B2 | 10/2003 | Krauss et al. |
| 6,662,874 | B2 | 12/2003 | Surjaatmadja et al. |
| 6,662,877 | B2 | 12/2003 | Patel |
| 6,712,160 | B1 | 3/2004 | Schultz et al. |
| 6,719,054 | B2 | 4/2004 | Cheng et al. |
| 6,722,427 | B2 | 4/2004 | Gano et al. |
| 6,725,933 | B2 | 4/2004 | Middaugh et al. |
| 6,769,490 | B2 | 8/2004 | Allamon et al. |
| 6,776,238 | B2 | 8/2004 | Dusterhoft et al. |
| 6,779,607 | B2 | 8/2004 | Middaugh et al. |
| 6,787,758 | B2 | 9/2004 | Tubel et al. |
| 6,789,619 | B2 | 9/2004 | Carlson et al. |
| 6,802,374 | B2 | 10/2004 | Edgar et al. |
| 6,907,936 | B2 | 6/2005 | Fehr et al. |
| 6,923,255 | B2 | 8/2005 | Lee |
| 6,938,690 | B2 | 9/2005 | Surjaatmadja |
| 6,997,252 | B2 | 2/2006 | Porter et al. |
| 6,997,263 | B2 | 2/2006 | Campbell et al. |
| 7,013,971 | B2 | 3/2006 | Griffith et al. |
| 7,021,384 | B2 | 4/2006 | Themig |
| 7,021,389 | B2 | 4/2006 | Bishop et al. |
| 7,055,598 | B2 | 6/2006 | Ross et al. |
| 7,066,265 | B2 | 6/2006 | Surjaatmadja |
| 7,090,153 | B2 | 8/2006 | King et al. |
| 7,096,954 | B2 | 8/2006 | Weng et al. |
| 7,108,067 | B2 | 9/2006 | Themig et al. |
| 7,134,505 | B2 | 11/2006 | Fehr et al. |
| 7,159,660 | B2 | 1/2007 | Justus |
| 7,168,493 | B2 | 1/2007 | Eddison |
| 7,195,067 | B2 | 3/2007 | Manke et al. |
| 7,219,730 | B2 | 5/2007 | Tilton et al. |
| 7,225,869 | B2 | 6/2007 | Willett et al. |
| 7,228,908 | B2 | 6/2007 | East, Jr. et al. |
| 7,234,529 | B2 | 6/2007 | Surjaatmadja |
| 7,237,612 | B2 | 7/2007 | Surjaatmadja et al. |
| 7,243,723 | B2 | 7/2007 | Surjaatmadja et al. |
| 7,252,147 | B2 | 8/2007 | Badalamenti et al. |
| 7,252,152 | B2 | 8/2007 | LoGiudice et al. |
| 7,273,099 | B2 | 9/2007 | East, Jr. et al. |
| 7,278,486 | B2 | 10/2007 | Alba et al. |
| 7,287,592 | B2 | 10/2007 | Surjaatmadja et al. |
| 7,290,611 | B2 | 11/2007 | Badalamenti et al. |
| 7,296,625 | B2 | 11/2007 | East, Jr. |
| 7,303,008 | B2 | 12/2007 | Badalamenti et al. |
| 7,306,043 | B2 | 12/2007 | Toekje et al. |
| 7,322,412 | B2 | 1/2008 | Badalamenti et al. |
| 7,322,417 | B2 | 1/2008 | Rytlewski et al. |
| 7,325,617 | B2 | 2/2008 | Murray |
| 7,337,844 | B2 | 3/2008 | Surjaatmadja et al. |
| 7,337,847 | B2 | 3/2008 | McGarian et al. |
| 7,343,975 | B2 | 3/2008 | Surjaatmadja et al. |
| 7,353,878 | B2 | 4/2008 | Themig |
| 7,353,879 | B2 | 4/2008 | Todd et al. |
| 7,367,393 | B2 | 5/2008 | Vachon |
| 7,377,321 | B2 | 5/2008 | Rytlewski |
| 7,377,322 | B2 | 5/2008 | Hofman |
| 7,385,523 | B2 | 6/2008 | Thomeer et al. |
| 7,387,165 | B2 | 6/2008 | Lopez de Cardenas et al. |
| 7,398,825 | B2 | 7/2008 | Nguyen et al. |
| 7,416,029 | B2 | 8/2008 | Telfer et al. |
| 7,419,002 | B2 | 9/2008 | Dybevik et al. |
| 7,422,060 | B2 | 9/2008 | Hammami et al. |

(56) References Cited

U.S. PATENT DOCUMENTS

| | | | | |
|---|---|---|---|---|
| 7,431,090 | B2 | 10/2008 | Surjaatmadja et al. | |
| 7,431,091 | B2 | 10/2008 | Themig et al. | |
| 7,464,764 | B2 | 12/2008 | Xu | |
| 7,478,676 | B2 | 1/2009 | East, Jr. et al. | |
| 7,503,390 | B2 | 3/2009 | Gomez | |
| 7,503,398 | B2 | 3/2009 | LoGiudice et al. | |
| 7,506,689 | B2 | 3/2009 | Surjaatmadja et al. | |
| 7,510,010 | B2 | 3/2009 | Williamson | |
| 7,510,017 | B2 | 3/2009 | Howell et al. | |
| 7,520,327 | B2 | 4/2009 | Surjaatmadja | |
| 7,527,103 | B2 | 5/2009 | Huang et al. | |
| 7,543,641 | B2 | 6/2009 | Contant | |
| 7,571,766 | B2 | 8/2009 | Pauls et al. | |
| 7,575,062 | B2 | 8/2009 | East, Jr. | |
| 7,617,871 | B2 | 11/2009 | Surjaatmadja et al. | |
| 7,621,337 | B2 | 11/2009 | Badalamenti et al. | |
| 7,628,213 | B2 | 12/2009 | Telfer | |
| 7,637,323 | B2 | 12/2009 | Schasteen et al. | |
| 7,644,772 | B2 | 1/2010 | Avant et al. | |
| 7,661,478 | B2 | 2/2010 | Palmer et al. | |
| 7,665,545 | B2 | 2/2010 | Telfer | |
| 7,673,673 | B2 | 3/2010 | Surjaatmadja et al. | |
| 7,673,677 | B2 | 3/2010 | King et al. | |
| 7,681,645 | B2 | 3/2010 | McMillin et al. | |
| 7,703,510 | B2 | 4/2010 | Xu | |
| 7,735,559 | B2 | 6/2010 | Malone | |
| 7,740,072 | B2 | 6/2010 | Surjaatmadja | |
| 7,740,079 | B2 | 6/2010 | Clayton et al. | |
| 7,748,460 | B2 | 7/2010 | Themig et al. | |
| 7,775,285 | B2 | 8/2010 | Surjaatmadja et al. | |
| 7,779,906 | B2 | 8/2010 | Porter et al. | |
| 7,802,627 | B2 | 9/2010 | Hofman et al. | |
| 7,849,924 | B2 | 12/2010 | Surjaatmadja et al. | |
| 7,849,925 | B2 | 12/2010 | Patel | |
| 7,861,788 | B2 | 1/2011 | Tips et al. | |
| 7,866,396 | B2 | 1/2011 | Rytlewski | |
| 7,866,402 | B2 | 1/2011 | Williamson, Jr. | |
| 7,866,408 | B2 | 1/2011 | Allison et al. | |
| 7,870,907 | B2 | 1/2011 | Lembcke et al. | |
| 7,878,255 | B2 | 2/2011 | Howell et al. | |
| 7,909,108 | B2 | 3/2011 | Swor et al. | |
| 7,926,571 | B2 | 4/2011 | Hofman | |
| 7,934,559 | B2 | 5/2011 | Posevina et al. | |
| 7,938,186 | B1 | 5/2011 | Badalamenti et al. | |
| 7,946,340 | B2 | 5/2011 | Surjaatmadja et al. | |
| 7,963,331 | B2 | 6/2011 | Surjaatmadja et al. | |
| 7,967,067 | B2 | 6/2011 | Irani et al. | |
| 8,162,050 | B2 | 4/2012 | Roddy et al. | |
| 8,191,625 | B2 | 6/2012 | Porter et al. | |
| 8,215,411 | B2 | 7/2012 | Flores et al. | |
| 8,245,788 | B2 | 8/2012 | Garcia et al. | |
| 8,267,178 | B1 | 9/2012 | Sommers et al. | |
| 8,276,674 | B2 | 10/2012 | Lopez de Cardenas et al. | |
| 8,276,675 | B2 | 10/2012 | Williamson et al. | |
| 8,291,980 | B2 | 10/2012 | Fay | |
| 8,297,367 | B2 | 10/2012 | Chen et al. | |
| 8,307,913 | B2 | 11/2012 | Dolman et al. | |
| 8,316,951 | B2 | 11/2012 | Fay et al. | |
| 8,365,824 | B2 | 2/2013 | Phillips | |
| 8,408,314 | B2 * | 4/2013 | Patel et al. | 166/373 |
| 8,418,769 | B2 | 4/2013 | Fay et al. | |
| 8,496,055 | B2 | 7/2013 | Mootoo et al. | |
| 8,505,639 | B2 | 8/2013 | Robison et al. | |
| 8,534,369 | B2 | 9/2013 | deBoer | |
| 8,540,035 | B2 | 9/2013 | Xu et al. | |
| 8,757,265 | B1 | 6/2014 | Cuffe et al. | |
| 2002/0027005 | A1 * | 3/2002 | McNeilly et al. | 166/301 |
| 2003/0029611 | A1 | 2/2003 | Owens | |
| 2006/0086507 | A1 | 4/2006 | Surjaatmadja et al. | |
| 2006/0157257 | A1 | 7/2006 | Ross et al. | |
| 2006/0207764 | A1 * | 9/2006 | Rytlewski | 166/313 |
| 2007/0102156 | A1 | 5/2007 | Nguyen et al. | |
| 2007/0261851 | A1 | 11/2007 | Surjaatmadja | |
| 2007/0272411 | A1 | 11/2007 | Lopez de Cardenas et al. | |
| 2007/0272413 | A1 * | 11/2007 | Rytlewski et al. | 166/318 |
| 2007/0284114 | A1 | 12/2007 | Swor et al. | |
| 2008/0000637 | A1 | 1/2008 | McDaniel et al. | |
| 2008/0060810 | A9 | 3/2008 | Nguyen et al. | |
| 2008/0135248 | A1 | 6/2008 | Talley et al. | |
| 2008/0202764 | A1 | 8/2008 | Clayton et al. | |
| 2008/0264641 | A1 | 10/2008 | Slabaugh et al. | |
| 2009/0084553 | A1 | 4/2009 | Rytlewski et al. | |
| 2009/0090501 | A1 | 4/2009 | Hansen et al. | |
| 2009/0223670 | A1 | 9/2009 | Snider | |
| 2009/0308588 | A1 | 12/2009 | Howell et al. | |
| 2010/0000727 | A1 | 1/2010 | Webb et al. | |
| 2010/0038093 | A1 * | 2/2010 | Patel | 166/375 |
| 2010/0044041 | A1 | 2/2010 | Smith et al. | |
| 2010/0155055 | A1 | 6/2010 | Ash et al. | |
| 2010/0200243 | A1 | 8/2010 | Purkis | |
| 2010/0200244 | A1 | 8/2010 | Purkis | |
| 2011/0036590 | A1 | 2/2011 | Williamson et al. | |
| 2011/0100643 | A1 | 5/2011 | Themig et al. | |
| 2011/0108272 | A1 | 5/2011 | Watson et al. | |
| 2011/0147088 | A1 | 6/2011 | Brunet et al. | |
| 2011/0155380 | A1 | 6/2011 | Frazier | |
| 2011/0155392 | A1 | 6/2011 | Frazier | |
| 2011/0180269 | A1 * | 7/2011 | Vestavik | 166/373 |
| 2011/0192607 | A1 | 8/2011 | Hofman et al. | |
| 2011/0253383 | A1 | 10/2011 | Porter et al. | |
| 2011/0278017 | A1 | 11/2011 | Themig et al. | |
| 2012/0061105 | A1 | 3/2012 | Neer et al. | |
| 2012/0111574 | A1 | 5/2012 | Desranleau et al. | |
| 2012/0160515 | A1 | 6/2012 | Braekke et al. | |
| 2013/0008647 | A1 | 1/2013 | Dirksen et al. | |
| 2013/0048290 | A1 | 2/2013 | Howell et al. | |
| 2013/0048291 | A1 | 2/2013 | Merron et al. | |
| 2013/0048298 | A1 | 2/2013 | Merron et al. | |
| 2013/0255938 | A1 | 10/2013 | Neer | |
| 2014/0158370 | A1 | 6/2014 | Porter et al. | |
| 2014/0166290 | A1 | 6/2014 | Howell | |

FOREIGN PATENT DOCUMENTS

| | | | |
|---|---|---|---|
| CN | 102518418 | A | 6/2012 |
| CN | 102518420 | A | 6/2012 |
| EP | 2216500 | A2 | 8/2010 |
| GB | 2321659 | A | 8/1998 |
| GB | 2323871 | A | 10/1998 |
| GB | 2332006 | A | 6/1999 |
| GB | 2415213 | B | 1/2009 |
| WO | 0246576 | A1 | 6/2002 |
| WO | 2004088091 | A1 | 10/2004 |
| WO | 2008070051 | A2 | 6/2008 |
| WO | 2008070051 | A3 | 6/2008 |
| WO | 2008070051 | B1 | 6/2008 |
| WO | 2008071912 | A1 | 6/2008 |
| WO | 2008093047 | A1 | 8/2008 |
| WO | 2009019461 | A1 | 2/2009 |
| WO | 2009029437 | A1 | 3/2009 |
| WO | 2009132462 | A1 | 11/2009 |
| WO | 2010001087 | A2 | 1/2010 |
| WO | 2010001087 | A3 | 1/2010 |
| WO | 2010058160 | A1 | 5/2010 |
| WO | 2010127457 | A1 | 11/2010 |
| WO | 2010128291 | A2 | 11/2010 |
| WO | 2010149644 | A1 | 12/2010 |
| WO | 2011018623 | A2 | 2/2011 |
| WO | 2011018623 | A3 | 2/2011 |
| WO | 2011058325 | A2 | 5/2011 |
| WO | 2011058325 | A3 | 5/2011 |
| WO | 2012037646 | A1 | 3/2012 |
| WO | 2012107730 | A2 | 8/2012 |
| WO | 2012107730 | A3 | 8/2012 |
| WO | 2012107730 | A8 | 8/2012 |
| WO | 2012107731 | A2 | 8/2012 |
| WO | 2012107731 | A3 | 8/2012 |
| WO | 2012164236 | A1 | 12/2012 |
| WO | 2013028385 | A2 | 2/2013 |
| WO | 2013028385 | A3 | 2/2013 |
| WO | 2013048696 | A1 | 4/2013 |

(56) References Cited

FOREIGN PATENT DOCUMENTS

| | | | |
|---|---|---|---|
| WO | 2013165643 | A2 | 11/2013 |
| WO | 2013165643 | A3 | 11/2013 |
| WO | 2014004144 | A2 | 1/2014 |

OTHER PUBLICATIONS

Patent application entitled "System and Method for Servicing a Wellbore," by Adam Kent Neer, filed Jun. 29, 2012 as U.S. Appl. No. 13/538,911.
Notice of Allowance dated Jul. 9, 2012 (11 pages), U.S. Appl. No. 12/617,405, filed Nov. 12, 2009.
Notice of Allowance dated Jul. 25, 2012 (9 pages), U.S. Appl. No. 12/539,392, filed Aug. 11, 2009.
Supplemental Notice of Allowability dated Aug. 22, 2012 (6 pages), U.S. Appl. No. 12/539,392, filed Aug. 11, 2009.
Foreign communication from a related counterpart application—International Search Report and Written Opinion, PCT/GB2008/002646, Dec. 11, 2008, 8 pages.
Foreign Communication from a related counterpart application—International Search Report and Written Opinion, PCT/GB2007/004628, Feb. 26, 2008, 8 pages.
Foreign commuunication from a related counterpart application—International Search Report and Written Opinion, PCT/GB2009/001505, Feb. 8, 2011, 8 pages.
Foreign communication from a related counterpart application—International Search Report and Written Opinion, PCT/GB2009/002693, Mar. 2, 2010, 8 pages.
Foreign communication from a related counterpart application—International Search Report and Written Opinion, PCT/GB2010/001524, Apr. 13, 2011, 11 pages.
Foreign communication from a related counterpart application—International Search Report and Written Opinion, PCT/GB2010/002090, Aug. 12, 2011, 11 pages.
Halliburton brochure entitled "Delta Stim® Completion Service," Sep. 2008, 4 pages, Halliburton.
Halliburton brochure entitled "Delta Stim™ Sleeve," Mar. 2007, 2 pages, Halliburton.
Halliburton brochure entitled "Swellpacker® cable system," Aug. 2008, 2 pages, Halliburton.
Halliburton brochure entitled "RapidFrac™ System," Mar. 2011, 3 pages.
Halliburton brochure entitled "sFrac™ Valve," Jun. 2010, 3 pages, Halliburton.
Halliburton Marketing Data Sheet, Sand Control, EquiFlow™ Inflow Control Devices, HO5600,01/08, pp. 1-2.
The Lee Company brochure entitled "Meet the EFS family," http://www.theleeco.com/EFSWEB2.NSF/Products!OpenPage, Apr. 21, 2009, 1 page.
The Lee Company brochure entitled "Meet the precision microhydraulics family," http://www.theleeco.com/LEEWEB2.NSF/AeroStart!OpenPage, Apr. 21, 2009, 2 pages.
Lohm calculator for gas flow, http://www.theleeco.com/EFSWEB2.NSF/airlohms.htm, Apr. 21, 2009, 2 pages, courtesy of The Lee Company.
Lohm calculator for liquid flow, http://www.theleeco.com/EFSWEB2.NSF/flowcalc.htm, Apr. 21, 2009, 2 pages, courtesy of The Lee Company.
Office Action (Final) dated Sep. 15, 2009 (12 pages), U.S. Appl. No. 11/609,128, filed Dec. 11, 2006.
Office Action dated Feb. 18, 2009 (18 pages), U.S. Appl. No. 11/609,128, filed Dec. 11, 2006.
Office Action dated Jun. 24, 2010 (13 pages), U.S. Appl. No. 12/139,604, filed Jun. 16, 2008.
Office Action dated Dec. 22, 2009 (18 pages), U.S. Appl. No. 12/139,604, filed Jun. 16, 2008.
Office Action (Final) dated Aug. 12, 2011 (12 pages), U.S. Appl. No. 12/166,257, filed Jul. 1, 2008.
Office Action dated Mar. 31, 2011 (19 pages), U.S. Appl. No. 12/166,257, filed Jul. 1, 2008.
Office Action dated Aug. 9, 2011 (24 pages), U.S. Appl. No. 12/539,392, filed Aug. 11, 2009.
Packers Plus brochure entitled "Achieve immediate production; StackFRAC® HD," Mar. 11, 2011, 4 pages.
Patent application entitled "A Method for individually servicing a plurality of zones of a subterranean formation," by Matthew Todd Howell, filed Feb. 10, 2011 as U.S. Appl. No. 13/025,039.
Patent application entitled "System and method for servicing a wellbore," by Jesse Cale Porter, et al., filed Feb. 10, 2011 as U.S. Appl. No. 13/025,041.
Patent application entitled "System and method for servicing a wellbore," by Jesse Cale Porter, et al., filed Jun. 2, 2011 as U.S. Appl. No. 13/151,457.
Patent application entitled "System and method for servicing a wellbore," by Matthew James Merron, et al., filed Aug. 23, 2011 as U.S. Appl. No. 13/215,553.
Packers Plus® Case Study entitled "Packers Plus launches the StackFRAC® HD "High Density" Multi-Stage Fracturing System to fulfill operator demand for more stimulation stages to increase production," 1 page.
Packers Plus brochure entitled "High Density Multi-Stage Fracturing System; StackFRAC® HD," Apr. 20, 2010, 2 pages.
Office Action (Final) dated Oct. 11, 2013 (17 pages), U.S. Appl. No. 13/025,039, filed Feb. 10, 2011.
Foreign communication from a related counterpart application—Invitation to Pay Additional Fees, PCT/US2012/050564, Nov. 5, 2013, 4 pages.
Foreign communication from a related counterpart application—International Search Report and Written Opinion, PCT/US2013/035122, Dec. 18, 2013, 13 pages.
Foreign communication from a related counterpart application—International Search Report and Written Opinion, PCT/US2013/046109, Dec. 18, 2013, 10 pages.
"Omega Tracer Deployment Valve (TDV)," XP054975262, Oct. 2, 2009, 1 page, http://www.youtube.com/watch?v=9nBh22_7EfA, Omega Completion Technology, Ltd.
Foreign communication from a related counterpart application—International Preliminary Report on Patentability, PCT/GB2012/000140, Dec. 2, 2013, 6 pages.
Office Action dated Mar. 28, 2012 (39 pages), U.S. Appl. No. 12/617,405, filed Nov. 12, 2009.
Office Action dated Apr. 4, 2012 (21 pages), U.S. Appl. No. 12/539,392, filed Aug. 11, 2009.
Patent application entitled "Responsively activated wellbore stimulation assemblies and methods of using the same," by William Mark Norrid, et al., filed Sep. 29, 2011 as U.S. Appl. No. 13/248,145.
Patent application entitled "Delayed activation activatable stimulation assembly," by Matthew James Merron, filed Apr. 30, 2012 as U.S. Appl. No. 13/460,453.
Office Action dated May 8, 2013 (51 pages), U.S. Appl. No. 13/025,039, filed Feb. 10, 2011.
Foreign communication from a related counterpart application—International Search Report and Written Opinion, PCT/GB2012/000141, Dec. 20, 2012, 11 pages.
Foreign communication from a related counterpart application—International Search Report and Written Opinion, PCT/GB2012/000139, Dec. 19, 2012, 11 pages.
Foreign communication from a related counterpart application—International Search Report and Written Opinion, PCT/US2012/054161, Feb. 8, 2013, 11 pages.
Office Action dated Jun. 18, 2013 (41 pages), U.S. Appl. No. 13/025,041, filed Feb. 10, 2011.
Office Action dated Jun. 18, 2013 (40 pages), U.S. Appl. No. 13/151,457, filed Jun. 2, 2011.
Foreign communication from a related counterpart application—International Preliminary Report on Patentability, PCT/GB2008/002646, Feb. 9, 2010, 6 pages.
Foreign communication from a related counterpart application—International Preliminary Report on Patentability, PCT/GB2007/004628, Jun. 16, 2009, 6 pages.
Foreign communication from a related counterpart application—International Preliminary Report on Patentability, PCT/GB2009/001505, Feb. 15, 2011, 5 pages.

(56) References Cited

OTHER PUBLICATIONS

Foreign communication from a related counterpart application—International Preliminary Report on Patentability, PCT/GB2009/002693, May 24, 2011, 6 pages.
Foreign communication from a related counterpart application—International Preliminary Report on Patentability, PCT/GB2010/001524, Feb. 14, 2012, 7 pages.
Foreign communication from a related counterpart application—International Preliminary Report on Patentability, PCT/GB2010/002090, May 15, 2012, 8 pages.
Foreign communication from a related counterpart application—International Preliminary Report on Patentability, PCT/GB2012/000139, Aug. 13, 2013, 6 pages.
Foreign communication from a related counterpart application—International Preliminary Report on Patentability, PCT/GB2012/000141, Aug. 13, 2013, 7 pages.
Office Action dated Feb. 4, 2014 (61 pages), U.S. Appl. No. 13/215,553, filed Aug. 23, 2011.
Filing receipt and specification entitled "System and Method for Servicing a Wellbore," by Jesse Cale Porter, et al., filed Jan. 15, 2014 as U.S. Appl. No. 14/156,232.
Office Action (Final) dated May 22, 2014 (15 pages), U.S. Appl. No. 13/215,553, filed Aug. 23, 2011.
Foreign communication from a related counterpart application—International Search Report and Written Opinion, PCT/US2012/050564, Feb. 14, 2014, 16 pages.
Filing receipt and specification entitled "A Method for Individually Servicing a Plurality of Zones of a Subterranean Formation," by Matthew Todd Howell, filed Feb. 24, 2014 as U.S. Appl. No. 14/187,761.
Foreign communication from a related counterpart application—International Preliminary Report on Patentability, PCT/US2012/050564, Mar. 6, 2014, 11 pages.
Office Action dated Jul. 30, 2014 (99 pages), U.S. Appl. No. 13/538,911, filed Jun. 29, 2012.
Office Action dated Aug. 21, 2014 (69 pages), U.S. Appl. No. 13/460,453, filed Apr. 30, 2012.
Foreign communication from a related counterpart application—Chinese Office Action with English translation, Application No. 201080059511.0, Mar. 5, 2014, 21 pages.
Foreign communication from a related counterpart application—Australian Examination Report, Application No. 2010317706, May 21, 2014, 4 pages.
Foreign communication from a related counterpart application—Canadian Office Action, CA 2,768,756, Apr. 24, 2014, 2 pages.
Foreign communication from a related counterpart application—International Search Report and Written Opinion, PCT/GB2010/001524, Apr. 13, 2011, 10 pages.
Foreign communication from a related counterpart application—International Preliminary Report on Patentability, PCT/US2012/054161, Apr. 1, 2014, 6 pages.

* cited by examiner

RESPONSIVELY ACTIVATED WELLBORE STIMULATION ASSEMBLIES AND METHODS OF USING THE SAME

CROSS-REFERENCE TO RELATED APPLICATIONS

Not applicable.

STATEMENT REGARDING FEDERALLY SPONSORED RESEARCH OR DEVELOPMENT

Not applicable.

REFERENCE TO A MICROFICHE APPENDIX

Not applicable.

BACKGROUND

Hydrocarbon-producing wells often are stimulated by hydraulic fracturing operations, wherein a servicing fluid such as a fracturing fluid or a perforating fluid may be introduced into a portion of a subterranean formation penetrated by a wellbore at a hydraulic pressure sufficient to create or enhance at least one fracture therein. Such a subterranean formation stimulation treatment may increase hydrocarbon production from the well.

In some wellbores, it may be desirable to individually and selectively create multiple fractures along a wellbore at a distance apart from each other, creating multiple "pay zones." The multiple fractures should have adequate conductivity, so that the greatest possible quantity of hydrocarbons in an oil and gas reservoir can be produced from the wellbore. Some payzones may extend a substantial distance along the length of a wellbore. In order to adequately induce the formation of fractures within such zones, it may be advantageous to introduce a stimulation fluid simultaneously via multiple stimulation assemblies. To accomplish this, it is necessary to configure multiple stimulation assemblies for the simultaneous communication of fluid via those stimulation assemblies. However prior art apparatuses, systems, methods have failed to efficiently and effectively so-configure multiple stimulation assemblies.

Thus, there is an ongoing need to develop new methods and apparatuses to enhance hydrocarbon production.

SUMMARY

Disclosed herein is a system for servicing a subterranean formation comprising a wellbore completion string comprising a first master activatable stimulation assembly, a first slave activatable stimulation assembly, wherein the first slave activatable stimulation assembly activates responsive to activation of the first master stimulation assembly; a second master activatable stimulation assembly, and a second slave activatable stimulation assembly, wherein the second slave activatable stimulation assembly activates responsive to activation of the second master stimulation assembly.

Also disclosed herein is a method of servicing a subterranean formation comprising positioning a wellbore completion string within the wellbore, wherein the wellbore completion string comprises a first master activatable stimulation assembly, a first slave activatable stimulation assembly, wherein the first master stimulation assembly and the first slave activatable stimulation assembly are positioned substantially adjacent to a first subterranean formation zone, a second master activatable stimulation assembly, and a second slave activatable stimulation assembly, activating the first master activatable stimulation assembly, wherein the first slave activatable stimulation assembly is activated responsive to activating the first master activatable stimulation assembly, and communicating a stimulation fluid to the first subterranean formation zone via the first master activatable stimulation assembly and the first slave activatable stimulation assembly.

BRIEF DESCRIPTION OF THE DRAWINGS

For a more complete understanding of the present disclosure and the advantages thereof, reference is now made to the following brief description, taken in connection with the accompanying drawings and detailed description.

DETAILED DESCRIPTION OF THE EMBODIMENTS

Figure 1:
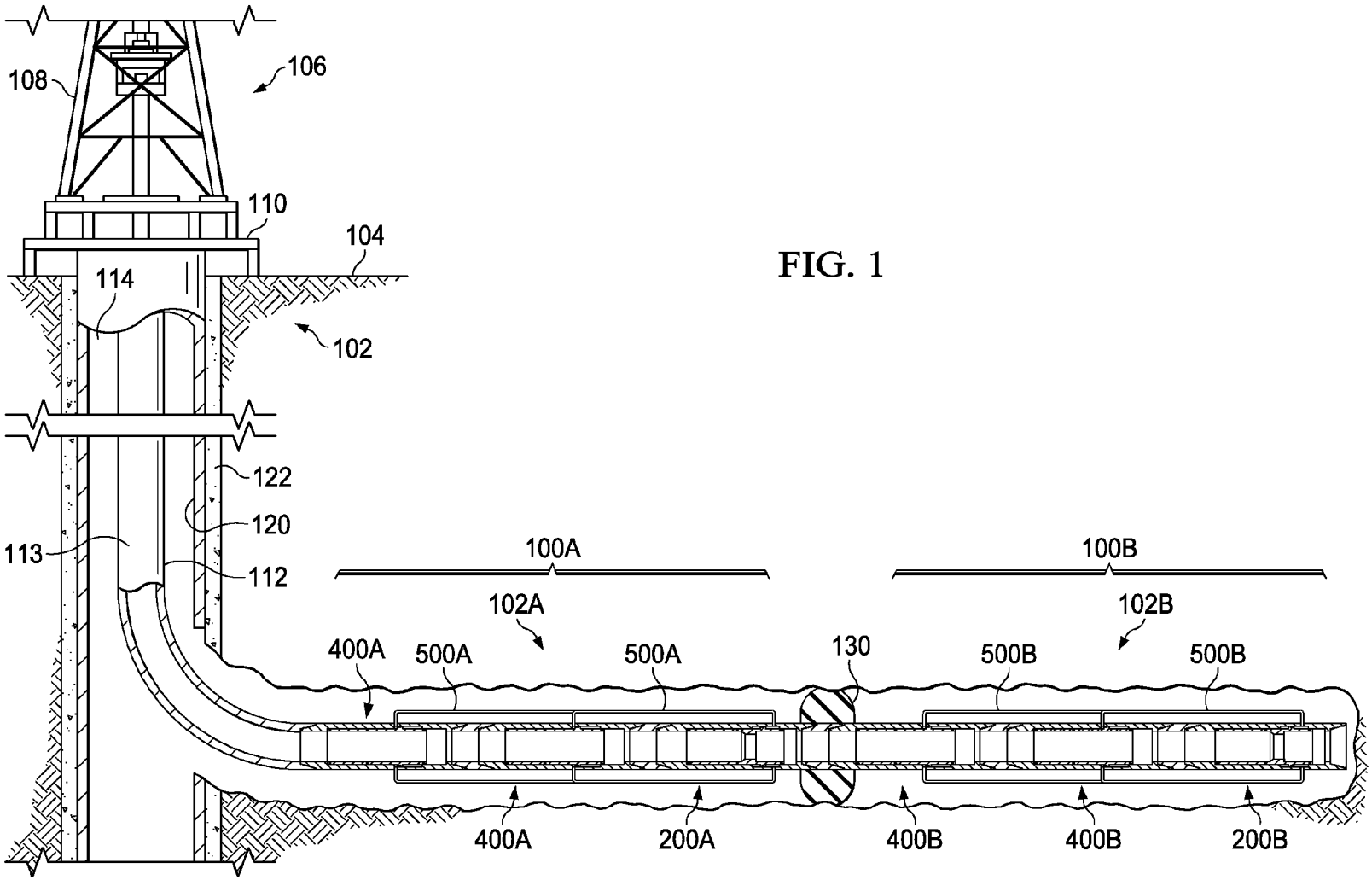
FIG. 1 is partial cut-away view of an embodiment of an environment in which at least one activatable stimulation assemblies (ASA) cluster comprising a master ASA and at least one slave ASA may be employed.

In the drawings and description that follow, like parts are typically marked throughout the specification and drawings with the same reference numerals, respectively. In addition, similar reference numerals may reference to similar components in different embodiments disclosed herein. The drawing figures are not necessarily to scale. Certain features of the invention may be shown exaggerated in scale or in somewhat schematic form and some details of conventional elements may not be shown in the interest of clarity and conciseness. The present invention is susceptible to embodiments of different forms. Specific embodiments are described in detail and are shown in the drawings, with the understanding that the present disclosure is not intended to limit the invention to the embodiments illustrated and described herein. It is to be fully recognized that the different teachings of the embodiments discussed herein may be employed separately or in any suitable combination to produce desired results.

Unless otherwise specified, use of the terms "connect," "engage," "couple," "attach," or any other like term describing an interaction between elements is not meant to limit the interaction to direct interaction between the elements and may also include indirect interaction between the elements described.

Unless otherwise specified, use of the terms "up," "upper," "upward," "up-hole," "upstream," or other like terms shall be construed as generally from the formation toward the surface or toward the surface of a body of water; likewise, use of "down," "lower," "downward," "down-hole," "downstream,"

or other like terms shall be construed as generally into the formation away from the surface or away from the surface of a body of water, regardless of the wellbore orientation. Use of any one or more of the foregoing terms shall not be construed as denoting positions along a perfectly vertical axis.

Unless otherwise specified, use of the term "subterranean formation" shall be construed as encompassing both areas below exposed earth and areas below earth covered by water such as ocean or fresh water.

Disclosed herein are embodiments of wellbore servicing apparatuses, systems, and methods of using the same. Particularly, disclosed herein are one or more of embodiments of a wellbore servicing system comprising one or more clusters of activatable stimulation assemblies (ASAs), each ASA cluster comprising a master ASA and at least one slave ASA configured for activation responsive to the activation of the master ASA.

Referring to FIG. 1, an embodiment of an operating environment in which such wellbore servicing apparatuses, systems, and methods may be employed is illustrated. It is noted that although some of the figures may exemplify horizontal or vertical wellbores, the principles of the apparatuses, systems, and methods disclosed may be similarly applicable to horizontal wellbore configurations, conventional vertical wellbore configurations, and combinations thereof. Therefore, the horizontal or vertical nature of any figure is not to be construed as limiting the wellbore to any particular configuration.

As depicted in FIG. 1, the operating environment generally comprises a wellbore 114 that penetrates a subterranean formation 102 for the purpose of recovering hydrocarbons, storing hydrocarbons, disposing of carbon dioxide, or the like. The wellbore 114 may be drilled into the subterranean formation 102 using any suitable drilling technique. In an embodiment, a drilling or servicing rig 106 comprises a derrick 108 with a rig floor 110 through which a workstring 112 (e.g., a drill string, a tool string, a segmented tubing string, a jointed tubing string, a casing string, or any other suitable conveyance, or combinations thereof) generally defining an axial flowbore 113 may be positioned within or partially within the wellbore 114. In an embodiment, the workstring 112 may comprise two or more concentrically positioned strings of pipe or tubing (e.g., a first workstring may be positioned within a second workstring). The drilling or servicing rig 106 may be conventional and may comprise a motor driven winch and other associated equipment for lowering the workstring 112 into the wellbore 114. Alternatively, a mobile workover rig, a wellbore servicing unit (e.g., coiled tubing units), or the like may be used to lower the workstring 112 into the wellbore 114. While FIG. 1 depicts a stationary drilling rig 106, one of ordinary skill in the art will readily appreciate that mobile workover rigs, wellbore servicing units (such as coiled tubing units), and the like may be employed.

The wellbore 114 may extend substantially vertically away from the earth's surface over a vertical wellbore portion, or may deviate at any angle from the earth's surface 104 over a deviated or horizontal wellbore portion. In alternative operating environments, portions or substantially all of the wellbore 114 may be vertical, deviated, horizontal, and/or curved.

In the embodiment of FIG. 1, at least a portion of the wellbore 114 is lined with a casing 120 that is secured into position against the formation 102 in a conventional manner using cement 122. In alternative operating environments, the wellbore 114 may be uncased and/or uncemented. In an alternative embodiment, a portion of the wellbore may remain uncemented, but may employ one or more packers (e.g., Swellpackers™, commercially available from Halliburton Energy Services, Inc.) to isolate two or more adjacent portions or zones within the wellbore 114.

In the embodiment of FIG. 1, a first ASA cluster 100A and a second ASA cluster 100B are incorporated within the workstring 112 and positioned proximate and/or substantially adjacent to a first subterranean formation zone (or "pay zone") 102A and a second subterranean formation zone (or pay zone) 102B, respectively. Although the embodiment of FIG. 1 illustrates two ASA clusters, one of skill in the art viewing this disclosure will appreciate that any suitable number of ASA clusters may be similarly incorporated within a workstring such as workstring 112, for example, 2, 3, 4, 5, 6, 7, 8, 9, 10, etc. ASA clusters. In the embodiment of FIG. 1, the master ASA 200A, 200B is located downhole from each of the associated slave ASAs 400A, 400B, respectively. In an alternative embodiment, a master ASA like master ASA 200A or 200B may be located uphole from, downhole from, or between a slave ASA like slave ASAs 400A or 400B.

In an embodiment, an ASA cluster, such as ASA cluster 100A or 100B, generally comprises a master ASA (with no reference to any particular master ASA, generally denoted as master ASA 200), at least one slave ASA (with no reference to any particular slave ASA, generally denoted as slave ASA 400), and linkages 500 directly or indirectly extending from the master ASA 200 to the at least one slave ASA 400 of the same ASA cluster. For example, in the embodiment of FIG. 1, the first ASA cluster 100A comprises a master ASA 200A, two slave ASAs 400A, and linkages 500A directly or indirectly extending from the master ASA 200A to the two slave ASAs 400A and, similarly, the second ASA cluster 100B comprises a master ASA 200B, two slave ASAs 400B, and linkages 500B directly or indirectly extending from the master ASA 200B to the two slave ASAs 400B. Although the embodiment of FIG. 1 illustrates each ASA cluster 100A, 100B, as comprising one master ASA 200A, 200B and two slave ASAs 400A, 400B, one of skill in the art viewing this disclosure will appreciate that an ASA cluster may comprise any suitable number of slave ASAs, for example, 2, 3, 4, 5, 6, 7, 8, 9, 10, etc. slave ASAs In an embodiment, each of the master ASA 200 and the one or more slave ASAs 400 is configured to be transitionable from a deactivated mode or configuration, in which the ASA does not provide a route of fluid communication from the workstring 112 (an interior flowbore) to the proximate or substantially adjacent zone of the subterranean formation 102, to an activated mode or configuration, in which the ASA will provide a route of fluid communication from the workstring 112 (an interior flowbore) to the proximate or substantially adjacent zone of the subterranean formation 102.

Unless otherwise specified, use herein of the term "master ASA" shall be construed to mean an ASA that, when transitioned from a deactivated mode to an activated mode, causes at least one other ASA of the same cluster to be transitioned from the deactivated mode to the activated mode. Also, unless otherwise specified, use herein of the term "slave ASA" shall be construed to mean an ASA that is activated responsive to the activation of another ASA of the same cluster. In an embodiment, a slave ASA such as slave ASA 400 may be activated responsive to the activation of a master ASA, such as master ASA 200, of the same ASA cluster. In an embodiment, a master ASA may be activated mechanically, hydraulically, electrically, electronically, or combinations therefore, as will be discussed herein. Also, in an embodiment a master ASA may be coupled to and configured to activated a slave ASA mechanically, hydraulically, electrically, or combinations thereof. Similarly, in an embodiment, a slave ASA may be coupled to and activated, responsive to the activation of a master ASA, mechanically, hydraulically, electrically, electronically, or combinations thereof, as will be discussed herein. In an embodiment as will be disclosed herein, an ASA may act as both a master ASA and a slave ASA, for example, in successive or sequential steps in an operational process or sequence.

Figure 2A:
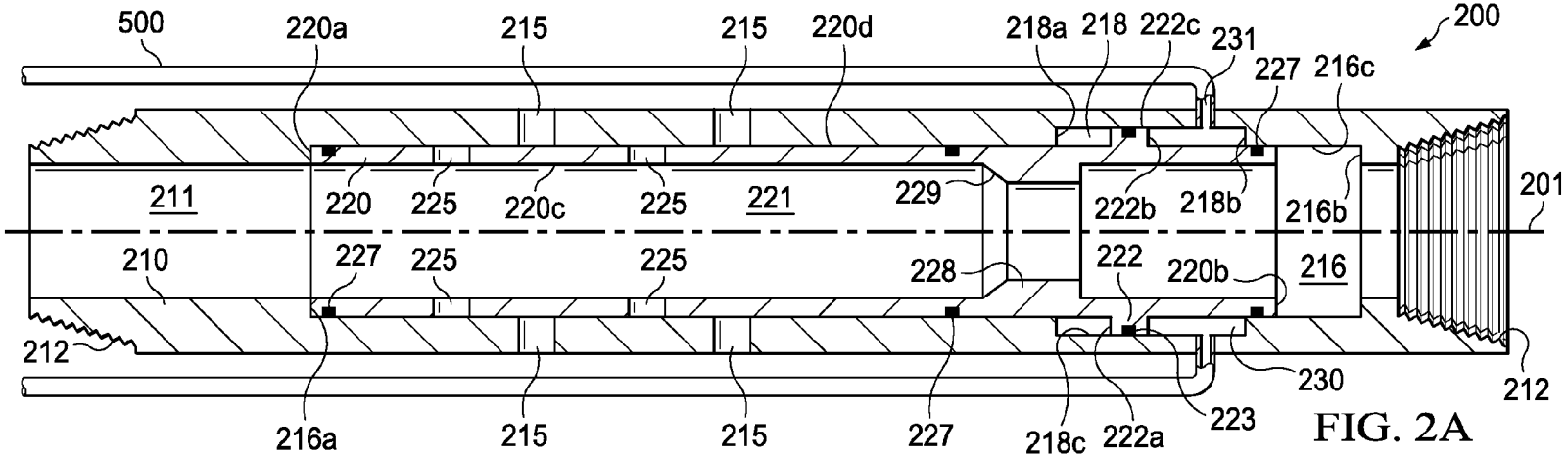
FIG. 2A is a cross-sectional view of an embodiment of a master ASA in a deactivated configuration.
Figure 2B:
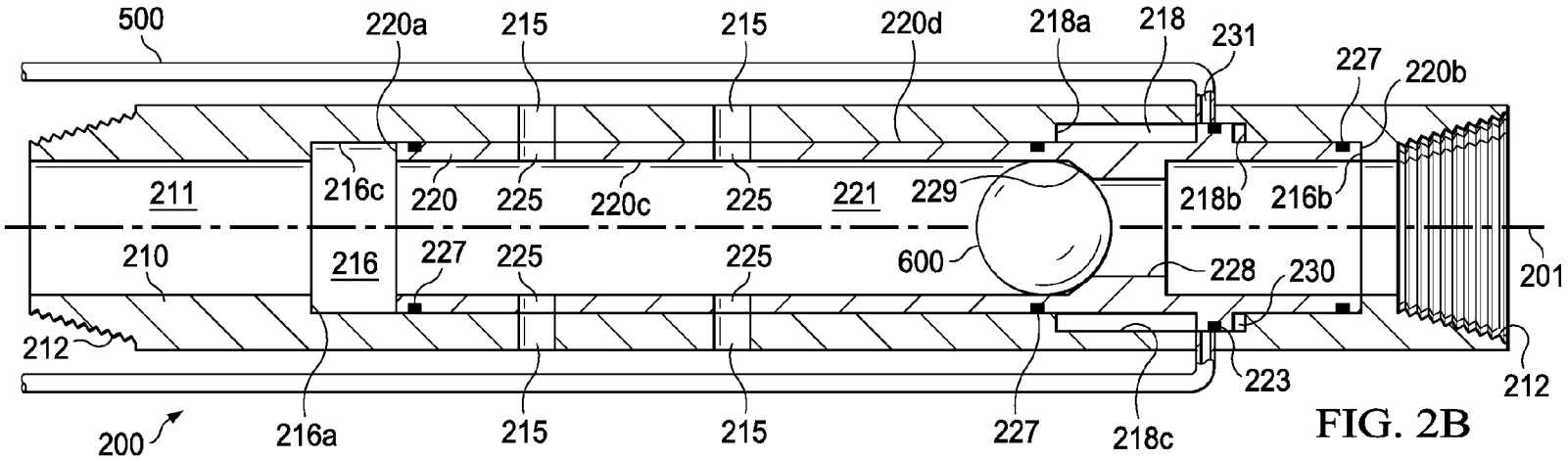
FIG. 2B is a cross-sectional view of an embodiment of a master ASA in a activated configuration.

Referring to FIG. 2A, an embodiment of a master ASA 200 is illustrated in the inactivated configuration and, referring to FIG. 2B, an embodiment of the master ASA 200 is illustrated in the activated configuration. In the embodiment of FIGS. 2A and 2B, the master ASA 200 is configured to be "ball-drop" activated (e.g., a combination of mechanical and hydraulic activation). Also in the embodiment of FIGS. 2A and 2B, the master ASA 200 is configured to activate the one or more associated slave ASAs 400 (i.e., the slave ASAs of the same ASA cluster) hydraulically. In the embodiment of FIGS. 2A and 2B, the master ASA 200 generally comprises a housing 210 and a sliding sleeve 220 which, together, generally define a fluid reservoir 230.

In an embodiment, the housing 210 may be characterized as a generally tubular body defining an axial flowbore 211 having a longitudinal axis 201. The axial flowbore 211 may be in fluid communication with the axial flowbore 113 defined by the workstring 112. For example, a fluid communicated via the axial flowbore 113 of the workstring 112 will flow into and the axial flowbore 211.

In an embodiment, the housing 210 may be configured for connection to and or incorporation within a workstring such as workstring 112. For example, the housing 210 may comprise a suitable means of connection to the workstring 112 (e.g., to a workstring member such as coiled tubing, jointed tubing, or combinations thereof). For example, in the embodiment of FIGS. 2A and 2B, the terminal ends of the housing 210 comprise one or more internally or externally threaded surfaces 212, for example, as may be suitably employed in making a threaded connection to the workstring 112. Alternatively, a master ASA may be incorporated within a workstring by any suitable connection, such as, for example, via one or more quick-connector type connections. Suitable connections to a workstring member will be known to those of skill in the art viewing this disclosure.

In an embodiment, the housing 210 may comprise a unitary structure (e.g., a continuous length of pipe or tubing); alternatively, the housing 210 may be comprise two or more operably connected components (e.g., two or more coupled sub-components, such as by a threaded connection). Alternatively, a housing like housing 210 may comprise any suitable structure, such suitable structures will be appreciated by those of skill in the art with the aid of this disclosure.

In an embodiment, the housing 210 may comprise one or more ports 215 suitable for the communication of fluid from the axial flowbore 211 of the housing 210 to a proximate subterranean formation zone when the master ASA 200 is so-configured (e.g., when the master ASA 200 is activated). For example, in the embodiment of FIG. 2A, the ports 215 within the housing 210 are obstructed, as will be discussed herein, and will not communicate fluid from the axial flowbore 211 to the surrounding formation. In the embodiment of FIG. 2B, the ports 215 within the housing 210 are unobstructed, as will be discussed herein, and may communicate fluid from the axial flowbore 211 to the surrounding formation. In an embodiment, the ports 215 may be fitted with one or more pressure-altering devices (e.g., nozzles, erodible nozzles, or the like). In an additional embodiment, the ports 215 may be fitted with plugs, screens, covers, or shields, for example, to prevent debris from entering the ports 215.

In an embodiment, the housing 210 comprises a sliding sleeve recess. For example, in the embodiment of FIGS. 2A and 2B, the housing 210 comprises a sliding sleeve recess 216. The sliding sleeve recess 216 may generally comprise a passageway (e.g., a circumferential recess extending a length along the longitudinal axis) in which the sliding sleeve 220 and may move longitudinally, axially, radially, or combinations thereof within the axial flowbore 211. In an embodiment, the sliding sleeve recess 216 may comprise one or more grooves, guides, or the like (e.g., longitudinal grooves), for example, to align and/or orient the sliding sleeve 220 via a complementary structure (e.g., one or more lugs) on the sliding sleeve 220. In the embodiment of FIGS. 2A and 2B, the sliding sleeve recess 216 is generally defined by an upper shoulder 216*a*, a lower shoulder 216*b*, and the recessed bore surface 216*c* extending between the upper shoulder 216*a* and lower shoulder 216*b* and comprises an inner diameter greater than the nominal inner diameter of the housing 210 outside the recess.

In an embodiment, the housing 210 comprises a piston recess at least partially defining the fluid reservoir 230. For example, in the embodiment of FIGS. 2A and 2B, the housing 210 comprises a piston recess 218 and, more specifically, the piston recess 218 is located within the sliding sleeve recess 216. The piston recess 218 may generally comprise a passageway (e.g., a circumferential recess extending a length along the longitudinal axis) in which a piston, as will be disclosed, of the sliding sleeve 220 may move longitudinally and/or axially. In the embodiment of FIGS. 2A and 2B, the piston recess 218 is generally defined by an upper shoulder 218*a*, a lower shoulder 218*b*, and the recessed bore surface 218*c* extending between the upper shoulder 218*a* and lower shoulder 218*b* and comprises an inner diameter greater than the nominal inner diameter of the sliding sleeve recess 216 outside the recess.

In an embodiment, the sliding sleeve 220 generally comprises a cylindrical or tubular structure. In an embodiment, the sliding sleeve 220 generally comprises an upper orthogonal face 220*a*, a lower orthogonal face 220*b*, an inner cylindrical surface 220*c* at least partially defining an axial flowbore 221 extending therethrough, and an outer cylindrical surface 220*d*. In an embodiment, the axial flowbore 221 defined by the sliding sleeve 220 may be coaxial with and in fluid communication with the axial flowbore 211 defined by the housing 210. In an embodiment, the thickness of the sliding sleeve 220 is about equal to the thickness or depth of the sliding sleeve recess 216 such that the inside diameter of the axial flowbores 211, 221 are about equal. In the embodiment of FIGS. 2A and 2B, the sliding sleeve 220 may comprise a single component piece. In an alternative embodiment, a sliding sleeve like the sliding sleeve 220 may comprise two or more operably connected or coupled component pieces.

In an embodiment, the sliding sleeve 220 may be slidably and concentrically positioned within the housing 210. In the embodiment of FIGS. 2A and 2B, the sliding sleeve 220 may be positioned within the sliding sleeve recess 216. For example, at least a portion of the outer cylindrical surface 220*d* of the sliding sleeve 220 may be slidably fitted against at least a portion of the recessed bore surface 216*c*.

In an embodiment, the sliding sleeve 220, the sliding sleeve recess 216, or both may comprise one or more seals at the interface between the outer cylindrical surface 220*d* of the sliding sleeve 220 and the recessed bore surface 216*c*. For example, in the embodiment of FIGS. 2A and 2B, the sliding sleeve 220 further comprises one or more radial or concentric recesses or grooves configured to receive one or more suitable fluid seals such as fluid seals 227, for example, to restrict fluid movement via the interface between the sliding sleeve 220 and the sliding sleeve recess 216. Suitable seals include but are not limited to a T-seal, an O-ring, a gasket, or combinations thereof.

In an embodiment, the sliding sleeve 220 may be slidably movable between a first position and a second position within the sliding sleeve recess 216. Referring again to FIG. 2A, the sliding sleeve 220 is shown in the first position. In the first position, the upper orthogonal face 220*a* of the sliding sleeve 220 may be located adjacent to and/or abut the upper shoulder 216*a* of the sliding sleeve recess 216. When the sliding sleeve 220 is in the first position, the sliding sleeve 220 may be characterized as in its upper-most position within the sliding sleeve recess 216 relative to the housing 210. Referring again to FIG. 2B, the sliding sleeve 220 is shown in the second position. In the second position, the lower orthogonal face 220*b* of the sliding sleeve 220 may be located adjacent to and/or abut the lower shoulder 216*b* of the sliding sleeve recess 216. When the sliding sleeve 220 is in the second position, the sliding sleeve 220 may be characterized as in its lower-most position within the sliding sleeve recess 216 relative to the housing 210.

In an embodiment, the sliding sleeve 220 comprises one or more ports 225 suitable for the communication of fluid from the axial flowbore 211 of the housing 210 and/or the axial flowbore 221 of the sliding sleeve 220 to a proximate subterranean formation zone when the master ASA 200 is so-configured. For example, in the embodiment of FIG. 2A where the sliding sleeve 220 is in the first position, the ports 225 within the sliding sleeve 220 are misaligned with the ports 215 of the housing and will not communicate fluid from the axial flowbore 211 and/or axial flowbore 221 to the wellbore and/or surrounding formation. In the embodiment of FIG. 2B where the sliding sleeve 220 is in the second position, the ports 225 within the sliding sleeve 220 are aligned with the ports 215 of the housing and will communicate fluid from the axial flowbore 211 and/or axial flowbore 221 to the wellbore and/or surrounding formation.

Figure 3A:
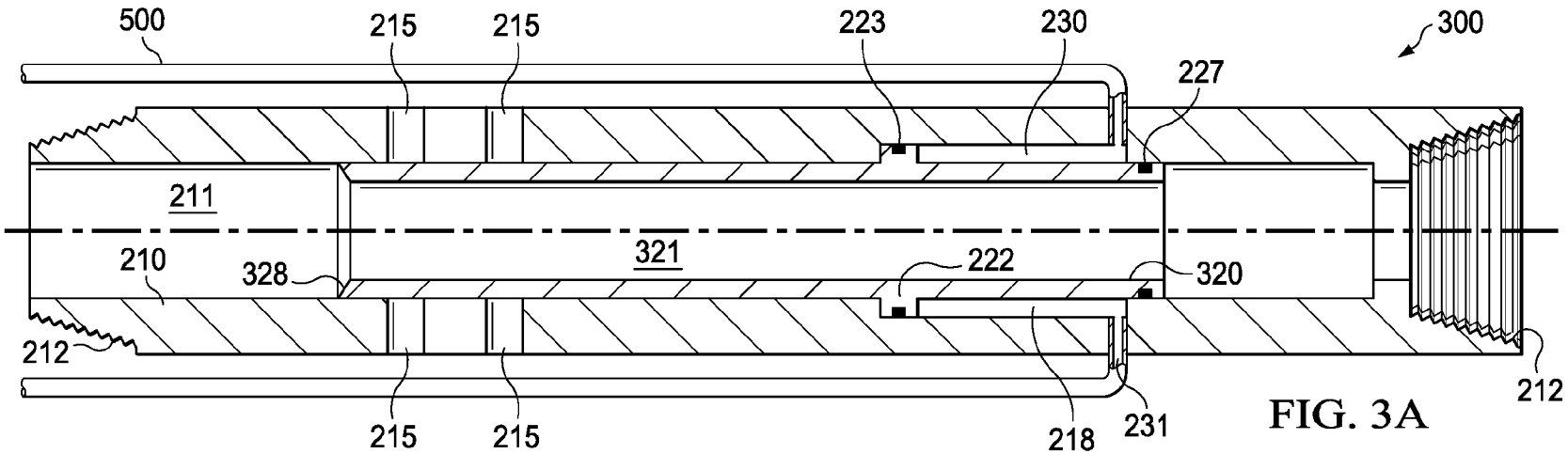
FIG. 3A is a cross-sectional view of an alternative embodiment of a master ASA in a deactivated configuration.
Figure 3B:
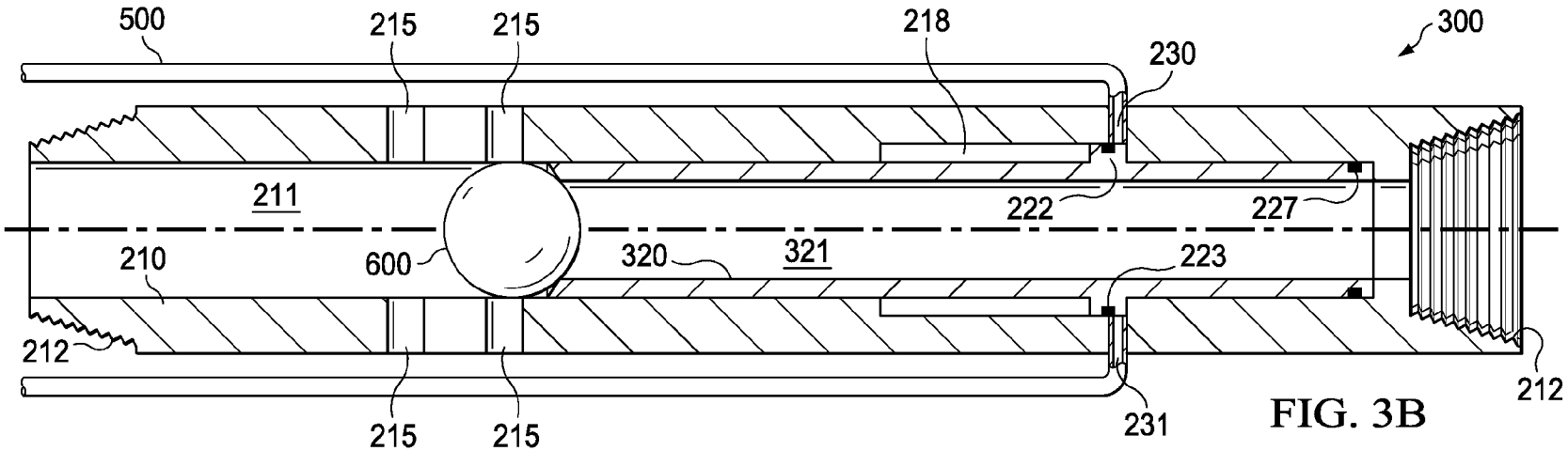
FIG. 3B is a cross-sectional view of an alternative embodiment of a master ASA in a activated configuration.

In an alternative embodiment, a sliding sleeve may not comprise a port for the communication of fluid to the surrounding formation. For example, referring to FIGS. 3A and 3B, an alternative embodiment of a master ASA is illustrated. In the embodiment of FIGS. 3A and 3B, ports for the communication of fluid from the axial flowbores 211 of the housing 210 and/or the axial flowbore 321 of the sliding sleeve 320 to a proximate subterranean formation zone are absent from the sliding sleeve 320. In the embodiment of FIG. 3A, when the sliding sleeve 320 is in the first position, the sliding sleeve 320 obstructs the ports 215 of the housing 210 and, thereby, restricts fluid communication via the ports 215. In the embodiment of FIG. 3B, when the sliding sleeve 320 is in the second position, the sliding sleeve 320 does not obstruct the ports 215 of the housing (e.g., as shifted or moved long the longitudinal axis such that the end of the sleeve has cleared the ports 215) and, thereby allows fluid communication via the ports 215.

In an embodiment, the sliding sleeve 220 may be configured to engage and/or be engaged with a suitable apparatus, tool, device, or the like for the purpose of transitioning the sliding sleeve 220 from the first position to the second position and/or from the second position to the first position. For example, in an embodiment the sliding sleeve 220 may be configured to receive, engage, and/or retain an obturating member (e.g., a ball or dart) of a given size and/or configuration moving via axial flowbore 211 and 221. In the embodiment of FIGS. 2A and 2B, the sliding sleeve 220 comprises a seat 228 having a reduced flowbore diameter in comparison to the diameter of axial flowbores 211 and 221 and, for example, to engage and retain an obturating member. In the embodiment of FIGS. 2A and 2B, the seat 228 comprises a bevel or chamfer 229 at the reduction in flowbore diameter. Referring again to FIGS. 3A and 3B, an alternative embodiment of a seat 328 is illustrated. In the embodiment of FIGS. 3A and 3B, the seat 328 is incorporated within the sliding sleeve 320. The seat 328 may similarly comprise a bevel or chamfer at the reduction in flowbore diameter. For example, the sliding sleeve 320 as shown in FIGS. 3A and 3B is not contained within a sliding sleeve recess, but rather is disposed within the interior flowbore 211 of the housing, and thus the upper end of the sliding sleeve 320 constricts the diameter of the flowbore and forms the seat 328. In an alternative embodiment, the sliding sleeve 320 may be disposed within a sliding sleeve recess as shown in FIGS. 2A and 2B and may further comprise a seat 228, thereby allowing the non-ported sliding sleeve 320 to be shifted or moved along the longitudinal axis such that the end of the sleeve has cleared the ports 215 and opened a flowpath there through. Unless otherwise indicated, description of structure with reference to FIGS. 2A and 2B will be likewise applicable to corresponding structure of FIGS. 3A and 3B.

In an alternative embodiment, the sliding sleeve 220 may be configured to mechanically engage and/or to be engaged with a shifting tool. For example, a sliding sleeve like sliding sleeve 220 may comprise one or more structures (such as lugs, grooves, slots, recesses, shoulders, protrusions, or combinations thereof) complementary to a structure of a shifting tool, as will be appreciated by one of skill in the art with the aid of this disclosure. Such a shifting tool may comprise a mechanical shifting tool, a fishing tool, or the like. In an embodiment, such a shifting tool may be conveyed into the wellbore via a wire-line, a tubing string (such as a coiled tubing string) or other conveyance. In addition, in such an embodiment, use of such a shifting tool may allow a sliding sleeve to be shifted in either direction (e.g., upward within the housing and/or downward within the housing, depending upon the type and/or configuration of shifting tool employed).

In an embodiment, the sliding sleeve 220 comprises a piston 222. In an embodiment, the piston 222 may extend circumferentially around a portion of the sliding sleeve 220. In the embodiment of FIGS. 2A and 2B, the piston 222 comprises an upper orthogonal face 222*a*, a lower orthogonal face 222*b*, and an outer cylindrical surface 222*c*. In an embodiment, the piston 222 may be slidably fitted within the piston recess 218. For example, in the embodiment of FIGS. 2A and 2B, the outer cylindrical surface 222*c* of the piston 222 may be slidably fitted against the recessed bore surface 218*c* of the piston recess 218.

In an embodiment, the piston 222, the piston recess 218, or both may comprise one or more seals at the interface between the outer cylindrical surface 222*c* of the piston 222 and the recessed bore surface 218*c*. For example, in the embodiment of FIGS. 2A and 2B, the piston 222 further comprises one or more radial or concentric recesses or grooves configured to receive one or more suitable fluid seals such as fluid seals 223, for example, to restrict fluid movement via the interface between the sliding sleeve 222 and the piston recess 218. Suitable seals include but are not limited to a T-seal, an O-ring, a gasket, or combinations thereof.

In an embodiment, the housing 210 and the sliding sleeve 220 may cooperatively define the fluid reservoir 230. For example, referring to FIGS. 2A and 2B, the fluid reservoir 230 is substantially defined by the recessed bore surface 218*c* of the piston recess 218, the lower shoulder 218*b* of the piston recess 218, the outer cylindrical surface 220*d* of the sliding sleeve 220, and the lower orthogonal face 222*b* of the piston 222.

In an embodiment, the fluid reservoir 230 may be characterized as having a variable volume, dependent upon the position of the sliding sleeve 220 relative to the housing 210. For example, when the sliding sleeve 220 is in the first position, the volume of the fluid reservoir 230 may be greatest and, when the sliding sleeve 220 is in the second position, the volume of the fluid reservoir 230 may be decreased. In the embodiment of FIG. 2A, where the sliding sleeve 220 is in the first position, the piston 222 is positioned such that the lower orthogonal face 222*b* of the piston 222 is a predetermined (e.g., a maximum) distance from the lower shoulder 218*b* of the piston recess 218, thereby increasing the volume of the fluid reservoir 230. In the embodiment of FIG. 2B, where the sliding sleeve 220 is in the second position, the piston 222 is positioned such that the lower orthogonal face 222*b* of the piston 222 is a predetermined (e.g., a minimal) distance from the lower shoulder 218*b* of the piston recess 218 (e.g., the piston 222 is substantially adjacent to the lower shoulder 218*b* of the piston recess 218), thereby reducing (e.g., minimizing) the volume of the fluid reservoir 230. In an embodiment, as the volume of the fluid reservoir 230 is varied (e.g., compressed by piston 222 upon movement of the sliding sleeve 220 with respect to the housing 210 from the first position to the second position), fluid may move out of the fluid reservoir 230 via fluid port 231.

In alternative embodiments, a master ASA like master ASA 200 may be configured to be activated other than by directly shifting the sliding sleeve from a first position to a second position, as disclosed herein above. For example, in a first alternative embodiment, a master ASA may be configured to transition from a deactivated configuration to an activated configuration upon passage of a time delay or upon the occurrence of an event (e.g., an application of fluid pressure or a release of fluid pressure). In such an embodiment a master ASA may further comprise a retention mechanism configured, when activated, to selectively retain the sliding sleeve in the first position, alternatively, the second position. Such a retention mechanism may comprise an additional sliding sleeve, a seat, or alternatively, structures configured to engage and/or be engaged by a shifting tool (e.g., grooves, slots, recesses, shoulders, protrusions, or combinations thereof). In such an embodiment, the sliding sleeve may be configured to transition from the deactivated configuration to the activated configuration upon deactivation of the retention mechanism. For example, the sliding sleeve may be biased (e.g., by a spring or a pressurized fluid) such that the sliding sleeve will transition from the first position to the second position when not restricted from movement by the retention mechanism. Alternatively, the sliding sleeve may be configured to move via the application of fluid pressure to the ASA.

In one example of such an alternative embodiment, the sliding sleeve is biased to move from the first position to the second position when not restricted. The sliding sleeve may be held in the first position by fluid within a fluid chamber and the fluid may be held in the fluid chamber when the retention mechanism is activated. Deactivation of the retention mechanism, for example, by shifting the retention mechanism, as by an obturating member or mechanical shifting tool, may allow the fluid to escape from the fluid chamber and the sliding sleeve to transition from the first position to the second position. In an embodiment, the fluid may escape from the fluid chamber via an orifice of a predetermined size and/or through a fluid meter configured to allow the fluid to pass at a predetermined rate. As such, the activation of the master ASA may be delayed by and/or carried out over a predetermined, desired amount of time.

In a second alternative embodiment, a master ASA like master ASA 200 may be configured to transition from a deactivated configuration to an activated configuration electrically and/or electronically. In such an embodiment, the master ASA may additionally comprise an electric motive force (for example, an electric motor), a power source, and/or actuator. Also, in such an embodiment, the motive force and the sliding sleeve may be configured to interact to move the sliding sleeve from the first position to the second position. For example, the motive force and sliding sleeve may comprise a rack and pinion gear arrangement, a worm-gear and cog arrangement, or the like. In such an embodiment, the actuator may generally comprise a switch configured to move from a first position to a second position and thereby activate and/or inactivate the motive force. The actuator may be configured to engage and/or to be engaged by an obturating member (e.g., a ball or dart) or a shifting tool, as disclosed herein above.

Figure 4A:
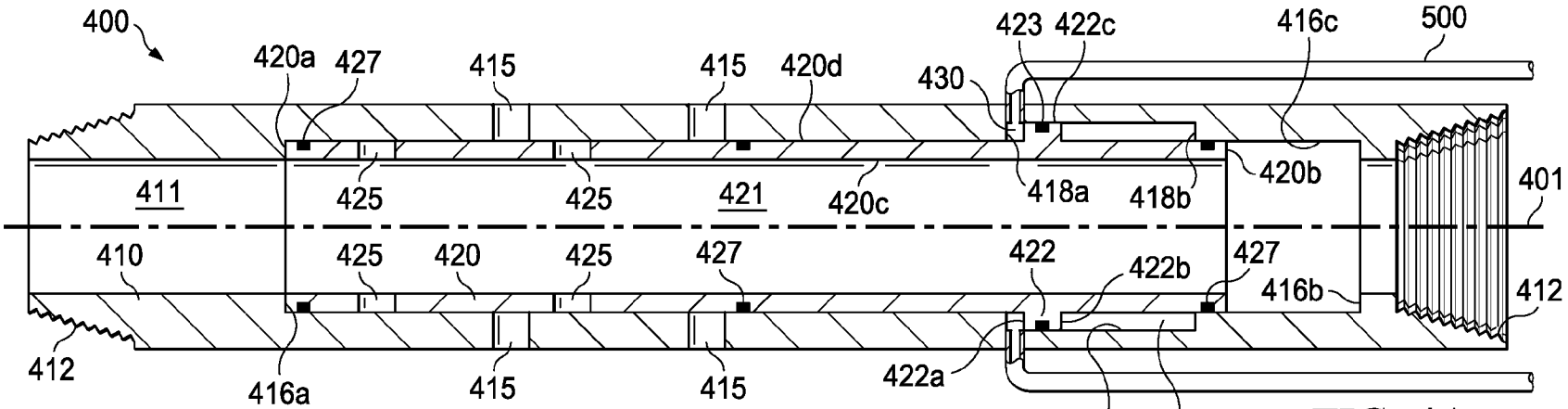
FIG. 4A is a cross-sectional view of an embodiment of a slave ASA in a deactivated configuration.
Figure 4B:
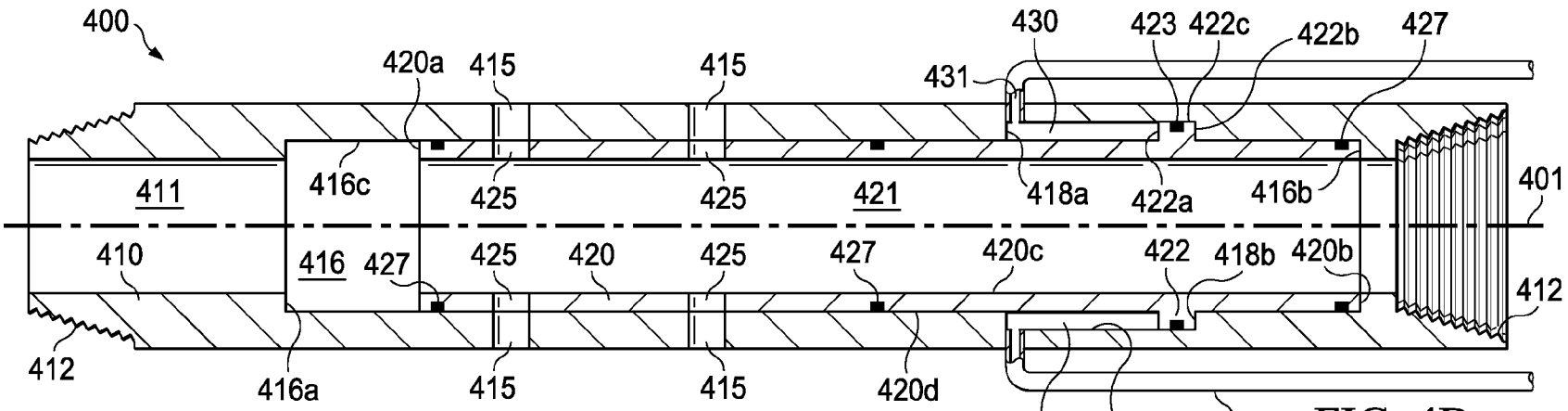
FIG. 4B is a cross-sectional view of an embodiment of a slave ASA in an activated configuration.

Referring to FIG. 4A, an embodiment of a slave ASA 400 is illustrated in the inactivated configuration and, referring to FIG. 4B, an embodiment of the slave ASA 400 is illustrated in the activated configuration. In the embodiment of FIGS. 4A and 4B, the slave ASA 400 is configured to be hydraulically activated. In the embodiment of FIGS. 4A and 4B, the slave ASA 400 generally comprises a housing 410 and a sliding sleeve 420 which, together, generally define a fluid reservoir 430.

In an embodiment, the housing 410 may be characterized as a generally tubular body defining an axial flowbore 411 having a longitudinal axis 401. The axial flowbore 411 may be in fluid communication with the axial flowbore 113 defined by the workstring 112. For example, a fluid communicated via the axial flowbore 113 of the workstring 112 will flow into and the axial flowbore 411.

In an embodiment, the housing 410 may be configured for connection to and or incorporation within a workstring such as workstring 112. For example, the housing may comprise a suitable means of connection to the workstring 112 (e.g., to a workstring member such as coiled tubing, jointed tubing, or combinations thereof). For example, in the embodiment of FIGS. 4A and 4B, the terminal ends of the housing 410 comprise one or more internally or externally threaded surfaces 412, for example, as may be suitably employed in making a threaded connection to the workstring 112. Alternatively, a slave ASA may be incorporated within a workstring by any suitable connection, such as, for example, via one or more quick-connector type connections. Suitable connections to a workstring member will be known to those of skill in the art viewing this disclosure.

In an embodiment, the housing 410 may comprise a unitary structure (e.g., a continuous length of pipe or tubing); alternatively, the housing 410 may be comprise two or more operably connected components (e.g., two or more coupled sub-components, such as by a threaded connection). Alternatively, a housing like housing 410 may comprise any suitable structure, such suitable structures will be appreciated by those of skill in the art with the aid of this disclosure.

In an embodiment, the housing 410 may comprise one or more ports 415 suitable for the communication of fluid from the axial flowbore 411 of the housing 410 to a proximate subterranean formation zone when the slave ASA 400 is so-configured (e.g., when the slave ASA is activated). For example, in the embodiment of FIG. 4A, the ports 415 within the housing 410 are obstructed, as will be discussed herein, and will not communicate fluid from the axial flowbore 411 to the surrounding formation. In the embodiment of FIG. 4B, the ports 415 within the housing 410 are unobstructed, as will be discussed herein, and may communicate fluid from the axial flowbore 411 to the surrounding formation. In an embodiment, the ports 415 may be fitted with one or more pressure-altering devices (e.g., nozzles, erodible nozzles, or the like). In an additional embodiment, the ports 415 may be fitted with plugs, screens, covers, or shields, for example, to prevent debris from entering the ports 415.

In an embodiment, the housing 410 comprises a sliding sleeve recess. For example, in the embodiment of FIGS. 4A and 4B, the housing 410 comprises a sliding sleeve recess 416. The sliding sleeve recess 416 may generally comprise a passageway (e.g., a circumferential recess extending a length along the longitudinal axis) in which the sliding sleeve 420 and may move longitudinally, axially, radially, or combinations thereof within the axial flowbore 411. In an embodiment, the sliding sleeve recess 416 may comprise one or more grooves, guides, or the like (e.g., longitudinal grooves), for example, to align and/or orient the sliding sleeve 420 via a complementary structure (e.g., one or more lugs) on the sliding sleeve 420. In the embodiment of FIGS. 4A and 4B, the sliding sleeve recess 416 is generally defined by an upper shoulder 416*a*, a lower shoulder 416*b*, and the recessed bore surface 416*c* extending between the upper shoulder 416*a* and lower shoulder 416*b* and comprises an inner diameter greater than the nominal inner diameter of the housing 410 outside the recess.

In an embodiment, the housing 410 comprises a piston recess at least partially defining the fluid reservoir 430. For example, in the embodiment of FIGS. 4A and 4B, the housing 410 comprises a piston recess 418 and, more specifically, the piston recess 418 is located within the sliding sleeve recess 416. The piston recess 418 may generally comprise a passageway (e.g., a circumferential recess extending a length along the longitudinal axis) in which a piston, as will be disclosed, of the sliding sleeve 420 may move longitudinally and/or axially. In the embodiment of FIGS. 4A and 4B, the piston recess 418 is generally defined by an upper shoulder 418*a*, a lower shoulder 418*b*, and the recessed bore surface 418*c* extending between the upper shoulder 418*a* and lower shoulder 418*b* and comprises an inner diameter greater than the nominal inner diameter of the sliding sleeve recess 416 outside the recess.

In an embodiment, the sliding sleeve 420 generally comprises a cylindrical or tubular structure. In an embodiment, the sliding sleeve 420 generally comprises an upper orthogonal face 420*a*, a lower orthogonal face 420*b*, an inner cylindrical surface 420*c* at least partially defining an axial flowbore 421 extending therethrough, and an outer cylindrical surface 420*d*. In an embodiment, the axial flowbore 421 defined by the sliding sleeve 420 may be coaxial with and in fluid communication with the axial flowbore 411 defined by the housing 410. In an embodiment, the thickness of the sliding sleeve 420 is about equal to the thickness or depth of the sliding sleeve recess 416 such that the inside diameter of the axial flowbores 411, 421 are about equal. In the embodiment of FIGS. 4A and 4B, the sliding sleeve 420 may comprise a single component piece. In an alternative embodiment, a sliding sleeve like the sliding sleeve 420 may comprise two or more operably connected or coupled component pieces.

In an embodiment, the sliding sleeve 420 may be slidably and concentrically positioned within the housing 410. In the embodiment of FIGS. 4A and 4B, the sliding sleeve 420 may be positioned within the sliding sleeve recess 416. For example, at least a portion of the outer cylindrical surface 420*d* of the sliding sleeve 420 may be slidably fitted against at least a portion of the recessed bore surface 416*c*.

In an embodiment, the sliding sleeve 420, the sliding sleeve recess 416, or both may comprise one or more seals at the interface between the outer cylindrical surface 220*d* of the sliding sleeve 420 and the recessed bore surface 416*c*. For example, in the embodiment of FIGS. 4A and 4B, the sliding sleeve 420 further comprises one or more radial or concentric recesses or grooves configured to receive one or more suitable fluid seals such as fluid seals 427, for example, to restrict fluid movement via the interface between the sliding sleeve 420 and the sliding sleeve recess 416. Suitable seals include but are not limited to a T-seal, an O-ring, a gasket, or combinations thereof.

In an embodiment, the sliding sleeve 420 may be slidably movable between a first position and a second position within the sliding sleeve recess 416. Referring again to FIG. 4A, the sliding sleeve 420 is shown in the first position. In the first position, the upper orthogonal face 420*a* of the sliding sleeve 420 may be located adjacent to and/or abut the upper shoulder 416*a* of the sliding sleeve recess 416. In the embodiment of FIG. 4A, when the sliding sleeve 420 is in the first position, the sliding sleeve 420 may be characterized as in its uppermost position within the sliding sleeve recess 416 relative to the housing 210. Referring again to FIG. 4B, the sliding sleeve 420 is shown in the second position. In the second position, the lower orthogonal face 420*b* of the sliding sleeve 420 may be located adjacent to and/or abut the lower shoulder 416*b* of the sliding sleeve recess 416. When the sliding sleeve 420 is in the second position, the sliding sleeve 420 may be characterized as in its lower-most position within the sliding sleeve recess 416 relative to the housing 410.

In an embodiment, the sliding sleeve 420 comprises one or more ports 425 suitable for the communication of fluid from the axial flowbore 411 of the housing 410 and/or the axial flowbore 421 of the sliding sleeve 420 to a proximate subterranean formation zone when the slave ASA 400 is so-configured. For example, in the embodiment of FIG. 4A where the sliding sleeve 420 is in the first position, the ports 425 within the sliding sleeve 420 are misaligned with the ports 415 of the housing and will not communicate fluid from the axial flowbore 411 and/or axial flowbore 421 to the wellbore and/or surrounding formation. In the embodiment of FIG. 4B where the sliding sleeve 420 is in the second position, the ports 425 within the sliding sleeve 420 are aligned with the ports 415 of the housing and will communicate fluid from the axial flowbore 411 and/or axial flowbore 421 to the wellbore and/or surrounding formation.

In an alternative embodiment, a sliding sleeve may not comprise a port for the communication of fluid to the surrounding formation. For example, a sliding sleeve may be configured similarly to the sliding sleeve illustrated in the alternative embodiment of FIGS. 3A and 3B. In such an embodiment, ports for the communication of fluid from the axial flowbores of the housing and/or the axial flowbore of the sliding sleeve may be absent from the sliding sleeve.

In an additional embodiment, a sliding sleeve like sliding sleeve 420 may be configured to engage and/or be engaged with a suitable apparatus, tool, device, or the like for the purpose of transitioning the sliding sleeve 220 from the first position to the second position and/or from the second position to the first position. For example, in an embodiment such a sliding sleeve may comprise a seat configured to receive, engage, and/or retain an obturating member (e.g., a ball or dart) of a given size and/or configuration moving via the axial flowbore. In such an embodiment, the seat may be configured to engage an obturating member of a size and/or configuration different from the obturating member that the seat 228 of the master ASA 200 is configured to engage. Alternatively, such a sliding sleeve may be configured to mechanically engage and/or to be engaged with a shifting tool. For example, such a sliding sleeve may comprise one or more structures (such as lugs, grooves, slots, recesses, shoulders, protrusions, or combinations thereof) complementary to a structure of a shifting tool, as will be appreciated by one of skill in the art with the aid of this disclosure.

In an embodiment, the sliding sleeve 420 comprises a piston 422. In an embodiment, the piston 422 may extend circumferentially around a portion of the sliding sleeve 420. In the embodiment of FIGS. 4A and 4B, the piston 422 comprises an upper orthogonal face 422*a*, a lower orthogonal face 222*b*, and an outer cylindrical surface 422*c*. In an embodiment, the piston 422 may be slidably fitted within the piston recess 418. For example, in the embodiment of FIGS. 4A and 4B, the outer cylindrical surface 422*c* of the piston 422 may be slidably fitted against the recessed bore surface 418*c* of the piston recess 418.

In an embodiment, the piston 422, the piston recess 418, or both may comprise one or more seals at the interface between the outer cylindrical surface 422*c* of the piston 422 and the recessed bore surface 418*c*. For example, in the embodiment of FIGS. 4A and 4B, the piston 422 further comprises one or more radial or concentric recesses or grooves configured to receive one or more suitable fluid seals such as fluid seals 423, for example, to restrict fluid movement via the interface between the sliding sleeve 422 and the piston recess 418. Suitable seals include but are not limited to a T-seal, an O-ring, a gasket, or combinations thereof.

In an embodiment, the housing 410 and the sliding sleeve 420 may cooperatively define the fluid reservoir 430. For example, referring to FIGS. 4A and 4B, the fluid reservoir 430 is substantially defined by the recessed bore surface 418*c* of the piston recess 418, the upper shoulder 418*a* of the piston recess 418, the outer cylindrical surface 420*d* of the sliding sleeve 420, and the upper orthogonal face 422*a* of the piston 422.

In an embodiment, the fluid reservoir 430 may be characterized as having a variable volume, dependent upon the position of the sliding sleeve 420 relative to the housing 410. For example, when the sliding sleeve 420 is in the first position, the volume of the fluid reservoir 430 may be decreased and, when the sliding sleeve 420 is in the second position, the volume of the fluid reservoir 430 may be increased. In the embodiment of FIG. 4A, where the sliding sleeve 420 is in the first position, the piston 422 is positioned such that the upper orthogonal face 422*a* of the piston 422 is nearest the upper shoulder 418*a* of the piston recess 418, thereby decreasing the volume of the fluid reservoir 430. In the embodiment of FIG. 4B, where the sliding sleeve 420 is in the second position, the piston 422 is positioned such that the upper orthogonal face 422*a* of the piston 422 is a predetermined (e.g., the maximum) distance from the upper shoulder 418*b* of the piston recess 418 (e.g., the piston 422 is adjacent to the lower shoulder 418*b* of the piston recess 418), thereby increasing the volume of the fluid reservoir 430. In an embodiment, as the volume of the fluid with reservoir 430 is varied, the volume of the fluid reservoir may be varied, resulting in the movement of the sliding sleeve (e.g., introduction of fluid into the fluid reservoir via a fluid port 431 may result in movement of the sliding sleeve 420 with respect to the housing 410 from the first position to the second position).

Figure 4C:
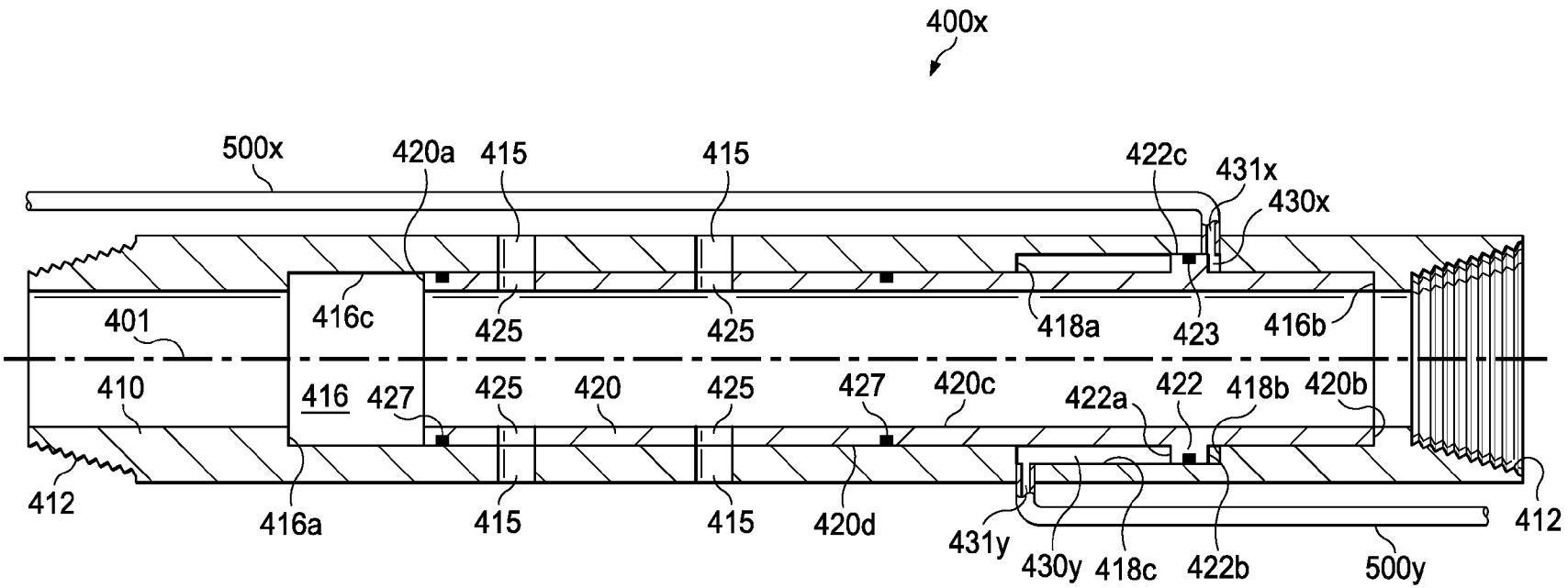
FIG. 4C is a cross-sectional view of an embodiment of an ASA configured to operate is both a master ASA and a slave ASA.

In an embodiment, an ASA may be configured to operate as both a slave ASA, in that it is activated responsive to the activation of another ASA, and a master ASA, in that its activation causes another ASA to be activated. Referring to FIG. 4C, an alternative embodiment of an ASA being configured to operate as both a master ASA and a slave ASA is illustrated. In the embodiment, of FIG. 4C, the housing 410 and the sliding sleeve 420 may cooperatively define a first fluid reservoir 430X and a second fluid reservoir 430Y. For example, the first fluid reservoir 430X is substantially defined by the recessed bore surface 418*c* of the piston recess 418, the upper shoulder 418*a* of the piston recess 418, the outer cylindrical surface 420*d* of the sliding sleeve 420, and the upper orthogonal face 422*a* of the piston 422 and the second fluid reservoir is substantially defined by the recessed bore surface 418*c* of the piston recess 418, the lower shoulder 418*b* of the piston recess 418, the outer cylindrical surface 420*d* of the sliding sleeve 420, and the lower orthogonal face 422*b* of the piston 422.

In the embodiment of FIG. 4C, the first fluid reservoir 430X and the second fluid reservoir 430Y may both be characterized as having a variable volume, dependent upon the position of the sliding sleeve 420 relative to the housing 410. In the embodiment of FIG. 4C, the first fluid reservoir 430X may be configured similarly to the fluid reservoir 230 of the master ASA 200 (e.g., as illustrated in and disclosed with reference to FIGS. 2A, 2B, 3A, and 3B) and the second fluid reservoir may be configured similarly to the fluid reservoir 430 of the slave ASA 400 (e.g., as illustrated in and disclosed with reference to FIGS. 4A and 4B). For example, when the sliding sleeve 420 is in the first position, the volume of the first fluid reservoir 430 may be increased and the volume of the second fluid reservoir 430Y may be decreased and, when the sliding sleeve 420 is in the second position, the volume of the first fluid reservoir 430X may be decreased and the volume of the second fluid reservoir 430Y may be increased.

In alternative embodiments, a slave ASA like slave ASA 400 may be configured to be activated other than by directly shifting the sliding sleeve from a first position to a second position, as disclosed herein above. For example, in a first alternative embodiment, a slave ASA may be configured to transition from a deactivated configuration to an activated configuration upon passage of a time delay or upon the occurrence of an event (e.g., an application of fluid pressure or a release of fluid pressure). In such an embodiment a slave ASA may further comprise a retention mechanism configured, when activated, to selectively retain the sliding sleeve in the first position, alternatively, the second position. Such a retention mechanism may comprise an additional sliding sleeve. In such an embodiment, the sliding sleeve may be configured to transition from the deactivated configuration to the activated configuration upon deactivation of the retention mechanism. For example, the sliding sleeve may be biased (e.g., by a spring or a pressurized fluid) such that the sliding sleeve will transition from the first position to the second position when not restricted from movement by the retention mechanism. Alternatively, the sliding sleeve may be configured to move via the application of fluid pressure to the ASA.

In one example of such an alternative embodiment, the sliding sleeve is biased to move from the first position to the second position when not restricted. The sliding sleeve may be held in the first position by fluid within a fluid chamber and the fluid may be held in the fluid chamber when the retention mechanism is activated. Deactivation of the retention mechanism, for example, upon receiving a suitable signal from the master ASA, may allow the fluid to escape from the fluid chamber and the sliding sleeve to transition from the first position to the second position. In an embodiment, the fluid may escape from the fluid chamber via an orifice of a predetermined size and/or through a fluid meter configured to allow the fluid to pass at a predetermined rate. As such, the activation of the slave ASA may be delayed by and/or carried out over a predetermined, desired amount of time.

In a second alternative embodiment, a slave ASA like slave ASA 400 may be configured to transition from a deactivated configuration to an activated configuration electrically and/or electronically. In such an embodiment, the slave ASA may additionally comprise an electric motive force (for example, an electric motor), and, optionally, a power source. Also, in such an embodiment, the motive force and the sliding sleeve may be configured to interact to move the sliding sleeve from the first position to the second position. For example, the motive force and sliding sleeve may comprise a rack and pinion gear arrangement, a worm-gear and cog arrangement, or the like. In such an embodiment, the motive force may be configured to move the sliding sleeve from the first position to the second position upon receiving a signal and/or electrical power from the master ASA.

In an embodiment, the master ASA 200 and the slave ASA are coupled to each other in a manner effective to achieve cooperative performance described herein. For example, the linkage 500 between the master ASA 200 and the slave ASA 400 may comprise any suitable conduit for communication of an electric current, the communication of a fluid (e.g., a hydraulic fluid), a mechanical assemblage, or the like, as may be appreciated by one of skill in the art with the aid of this disclosure. In the embodiments of FIGS. 1 through 4B, where the master ASA 200 is configured to activate the slave ASA 400 hydraulically and the slave ASA 400 is configured to be activated hydraulically, the one or more linkages 500 may comprise a hydraulic conduit (e.g., a hose, a pipe, a tubing, or the like). The linkages 500 may be operably connected to the fluid ports 231 of the master ASA 200 and the fluid ports 431 of the slave ASA 400 (e.g., configured to communicate fluid between the fluid ports 231 of the master ASA 200 and the fluid ports 431 of the slave ASA 400). In an alternative embodiment, the linkages may comprise a mechanical linkage, for example, a wireline, a rod, a cable, or the like, or an electrical linkage, for example, one or more wires suitable for the conveyance of an electrical current.

In an embodiment, the linkages 500 provided with a protective covering, for example, the linkages 500 may be contained within a groove, slot, encasement, or hollow within the housings 210, 410. In various embodiments, the linkages 500 may be provided on and/or about the exterior of the housings 210, 410; in such an embodiment, the linkages may be secured and/or fastened to the ASAs 200, 400. Alternatively, the linkages may be provided and/or secured within the housings 210, 410.

In an embodiment, the linkages may be provided in a suitable number. For example, in the embodiments of FIGS. 2A through 4B, the ASAs 200, 400 are illustrated as comprising two linkages each; however, this disclosure should not be construed as so-limited. For example, an ASA like ASAs 200 or 400 may comprise one, three, four, five, or more suitable linkages extending between two of more ASAs. In an embodiment, the linkages may comprise sections or joints, as will be appreciated by one of skill in the art viewing this disclosure.

One or more of embodiments of a wellbore servicing system comprising one or more ASA clusters (e.g., ASA clusters 100A and 100B) having been disclosed, also disclosed herein are one or more embodiments of a wellbore servicing method employing such an ASA cluster. In an embodiment, a wellbore servicing method may generally comprise the steps of positioning an ASA cluster, such as clusters 100A or 100B, proximate to a zone of a subterranean formation, isolating adjacent zones of the subterranean formation, transitioning the master ASA and the slave ASA of the given ASA cluster to an activated configuration, and communicating a servicing fluid from to the zone of the subterranean formation via the master ASA and the slave ASA.

Referring again to FIG. 1, in an embodiment, one or more ASA clusters, such as the first ASA cluster 100A and/or the second ASA cluster 100B, may be incorporated within a workstring such as workstring 112, for example as disclosed herein. The workstring 112 may be positioned within a wellbore such as wellbore 114 such that the first ASA cluster 100A is proximate and/or substantially adjacent to the first subterranean formation zone 102A and the second ASA cluster is proximate and/or substantially adjacent to the second subterranean formation zone 102B. In an embodiment, the master ASA 200A and the slave ASAs 400A of the first ASA cluster 100A and the master ASA 200B and the slave ASAs 400B of the second ASA cluster 100B may be positioned within the wellbore 114 in a deactivated configuration (e.g., in a configuration in which no ASA will communicate fluid to the subterranean formation.

In an embodiment, once the first ASA cluster 100A and the second ASA cluster 100B have been positioned within the wellbore 114, the first zone 102A may be isolated from the second zone. For example, in the embodiment of FIG. 1, the first zone 102A is separated from the second zone 102B via the operation of a suitable wellbore isolation device 130. Suitable wellbore isolation devices are generally known to those of skill in the art and include but are not limited to packers, such as mechanical packers and swellable packers (e.g., Swellpackers™, commercially available from Halliburton Energy Services, Inc.), sand plugs, sealant compositions such as cement, or combinations thereof.

In an embodiment, once the first ASA cluster 100A and the second ASA cluster 100B have been positioned within the wellbore 114 and, optionally, once adjacent zones of the subterranean formation (e.g., zones 102A and 102B) have been isolated, one of the clusters (e.g., the first ASA cluster 100A or the second ASA cluster 100B) may be prepared for the communication of fluid to the proximate and/or adjacent zone (e.g., zones 102A and 102B).

In an embodiment, the zones of the subterranean formation 102A, 102B may be serviced working from the zone that is furthest downhole zone (e.g., in the embodiment of FIG. 1, the second zone 102B) progressively upward toward the least downhole zone (e.g., in the embodiment of FIG. 1, the first zone 102A).

In such an embodiment, the master ASA 200B and the slave ASA 400B (which are positioned proximate and/or substantially adjacent to the second zone 102B) are transitioned from the deactivated configuration to the activated configuration. In an embodiment, transitioning the master ASA 200B and the slave ASA 400B to the activated configuration may comprise introducing an obturating member (e.g., a ball or dart) configured to engage the seat of the master ASA 200B into the workstring 112 and forward-circulating the obturating member to engage the seat 228 of the master ASA 200B. In the embodiment of FIG. 1, because the master ASA 200A is incorporated within the workstring 112 uphole from the master ASA 200B, an obturating member configured to engage the seat 228 of the master 200B may also be configured to pass through the master ASA 200A without engaging or being retained by the seat 228 therein. For example, where the obturating member comprises a ball, the ball may be smaller in diameter than the inner bore diameter of the seat 228 of the master ASA 200A.

In an embodiment, when the obturating member has engaged the seat 228, continuing to pump fluid may increase the force applied to the sliding sleeve 220 via the obturating member 600. Application of force to the sliding sleeve 220 via the seat 228 may cause the sliding sleeve to slidably move from the first position (e.g., as shown in FIG. 2A) to the second position (e.g., as shown in FIG. 2B) and thereby transitioning the master ASA 200B to an activated configuration.

In an alternative embodiment, for example, where a master ASA like master ASA 200 is configured to engage a mechanical shifting tool, transitioning the master ASA and the slave ASA to the activated configuration may comprise positioning the mechanical shifting tool proximate and/or adjacent (e.g., within the axial flowbore of) the master ASA and actuating the shifting tool, thereby causing the mechanical shifting tool to engage structures (e.g., lugs, grooves, slots, recesses, shoulders, protrusions, or combinations thereof) within the sliding sleeve of the master ASA. For example, the mechanical shifting tool may be positioned proximate and/or adjacent to the master ASA by lowering the tool into the workstring 112 on a wireline or attached to the end of a coiled tubing string. When the mechanical shifting tool engages the sliding sleeve, the sleeve may be manipulated relative to the housing of the ASA by pulling on the wireline or pulling and/or pushing on the coiled tubing, thereby shifting the master ASA and the related slave ASA(s) from the deactivated configuration to the activated configuration.

In other alternative embodiments, engaging an obturating member, alternatively, a shifting tool, so as to transition a sleeve or the like from a first position to a second position may result in the actuation of a motive force (e.g., an electric motor) or transitioning the master ASA into a delay mode wherein the sliding sleeve will transition from the first position to the second position after the passage of a predetermined amount of time, as disclosed herein above.

As the sliding sleeve 220 moves from the first position to the second position, the piston 222 moves within the piston recess 218, thereby decreasing the volume of fluid reservoir 230. As the volume of the fluid reservoir 230 is decreased (e.g., by movement of the sliding sleeve 220 and the piston 222 with respect to the housing 210) a fluid contained therein (e.g., a hydraulic fluid, or the like) may be compressed and may flow out of the fluid reservoir 230 of the master ASA 200B and into the fluid reservoir 430 of the one or more slave ASAs 400B via linkages 500. As the hydraulic fluid flows into the fluid reservoir 430 of the slave ASAs 400B, the piston 422 is forced away from the upper orthogonal face 418*a* of the piston recess 418, causing the sliding sleeve 420 of the slave ASA 400B to slide within the housing 410 from the first position (e.g., as shown in FIG. 4A) to the second position (e.g., as shown in FIG. 4B) and thereby transitioning the slave ASA 400B to an activated configuration. As such, the slave ASA 400B may be transitioned from deactivated configuration to an activated configuration responsive to and substantially simultaneously with the master ASA 200 being transitioned from the deactivated configuration to the activated configuration.

In alternative embodiments, movement of a sliding sleeve like sliding sleeve 220 from the first position to the second position may result in the actuation of a motive force (e.g., an electric motor) in a slave ASA like slave ASA 400 or transitioning the slave ASA into a delay mode wherein the sliding sleeve will transition from the first position to the second position after the passage of a predetermined amount of time, as disclosed herein above.

In an embodiment, the volume of fluid reservoir 230 and/or 430 may be configured such that the volume of hydraulic fluid leaving fluid reservoir 230 may be sufficient to transition one, two, three, or more slave ASAs from the deactivated to the activated configuration.

In an alternative embodiment, a hydraulic fluid may be transferred from a first slave ASA fluid reservoir 430 to a second ASA fluid reservoir 430 to transition the second slave ASA to the activated configuration. For example, referring again to FIG. 4C, in an embodiment where an ASA is configured to operate as both a slave ASA and a master ASA, as fluid flows into the second fluid reservoir 430Y of the slave ASA 400X via linkage 500Y, the piston 422 is forced away from the upper orthogonal face 418*a* of the piston recess 418, causing the sliding sleeve 420 of the ASA 400X to slide within the housing 410 from the first position (e.g., as similarly shown in FIG. 4A) to the second position (e.g., as shown in FIG. 4C) and thereby transitioning the slave ASA 400X to an activated configuration. As the sliding sleeve 420 moves from the first position to the second position, the piston 422 moves within the piston recess 418, also thereby decreasing the volume of the first fluid reservoir 430X. As the volume of the first fluid reservoir 430 is decreased (e.g., by movement of the sliding sleeve 420 and the piston 422 with respect to the housing 410) a fluid contained therein (e.g., a hydraulic fluid, or the like) may be compressed and may flow out of the first fluid reservoir 430X of the ASA 400X and into the fluid reservoir 430 of the one or more additional ASAs via linkages 500X. As such, the ASA 400X may function as both a slave ASA, in the it is activated responsive to the activation of another ASA, and a master ASA, in that its activation causes another ASA to be activated.

In an embodiment, once the master ASA 200B and the slave ASAs 400 have been transitioned from the deactivated configuration to the activated configuration, a suitable wellbore servicing fluid may be communicated to the second subterranean formation zone 102B via the ports (e.g., ports 215 and 225 and 415 and 425) of the activated ASAs (e.g., 200B and 400B). Nonlimiting examples of a suitable wellbore servicing fluid include but are not limited to a fracturing fluid, a perforating or hydrajetting fluid, an acidizing fluid, the like, or combinations thereof. The wellbore servicing fluid may be communicated at a suitable rate and pressure. For example, the wellbore servicing fluid may be communicated at a rate and/or pressure sufficient to initiate or extend a fluid pathway (e.g., a perforation or fracture) within the subterranean formation 102.

In an embodiment, once the servicing operation has been completed with respect to the second subterranean formation zone 102B, the servicing operation with respect to the first subterranean formation zone 102A may commence. In an embodiment, the servicing operation with respect to the first subterranean formation zone 102A may progress by substantially the same methods as disclosed with respect to the second subterranean formation zone 102B. In an embodiment where the servicing operation progresses from the zone that is furthest downhole zone (e.g., in the embodiment of FIG. 1, the second zone 102B) progressively upward toward the least downhole zone (e.g., in the embodiment of FIG. 1, the first zone 102A) and in an embodiment where the master ASA 200 is located below the slave ASAs 400 of the same cluster, it may be unnecessary to close and/or isolate an ASA cluster after the servicing operation has been completed with respect to that cluster. For example, because an obturating member will engage a seat like seat 228 within the master ASA in the cluster above (uphole from) that ASA cluster, the obturating member may restrict the passage of fluid to those downhole ASA clusters that remain in an activated configuration.

In an alternative embodiment, it may be desirable to inactive an ASA cluster after the servicing operation has been completed with respect to that ASA cluster. In an embodiment, it may be possible to transition the ASAs in an ASA cluster from the activated configuration to an inactivated configuration. For example, in an embodiment where a slave ASA comprises a seat configured to engage an obturating member of a given size and/or configuration or, alternatively, a mechanical shifting tool, the slave ASA may be transitioned from the activated configuration to the inactivated configuration similarly to transitioning the master ASA from the inactivated configuration to the activated configuration. Similarly, fluid may flow out of the fluid chambers of the slave ASA in back into the chamber of the master ASA, thereby forcing the sliding sleeve within the master ASA from the second position back to the first position.

For example, in an embodiment where an ASA cluster comprises three ASAs (e.g., a lower-most, intermediate, and upper-most ASA), during an activation sequence (e.g., where the ASAs are transitioned from the inactivated configuration to the activated configuration) the lower-most ASA may be operable as a master ASA, the intermediate ASA may be operable as both a master ASA and a slave ASA, and the upper-most ASA may be operable as a slave ASA. For example, in such an activation sequence, the intermediate ASA may be activated responsive to the activation of the lower-most ASA and the upper-most ASA may be activated responsive to the activation of the intermediate ASA.

Similarly, during an inactivation sequence (e.g., where the ASAs are transitioned from the activated configuration to the inactivated configuration), the upper-most ASA may be operable as a master ASA, the intermediate ASA may be operable as both a master ASA and a slave ASA, and the lower-most ASA may be operable as a slave ASA. Particularly, in such an inactivation sequence, the intermediate ASA may be inactivated responsive to the inactivation of the upper-most ASA, for example, by one of the means disclosed herein, and the lower-most ASA may be inactivated responsive to the inactivation of the intermediate ASA.

In an embodiment, an ASA cluster such as ASA cluster 100A or 100B, and/or an ASA such as master ASA 200, master ASA 300 or slave ASA 400 may be advantageously employed in the performance of a wellbore servicing operation. For example, the ability to activate a slave ASA responsive to the activation of a master ASA, as disclosed herein, may improve the efficiency of such a servicing operation by decreasing the number of balls or darts that must be communicated downhole to transition a downhole tool from a first configuration to a second configuration. Further, the simultaneous or nearly simultaneous activation of multiple stimulation tools (such as the ASAs of a give ASA cluster, as disclosed herein) may allow an operator to advantageously communicate a high volume of stimulation fluid to a given zone of a subterranean formation, for example, in the performance of a high-rate fracturing operation.

ADDITIONAL DISCLOSURE

The following are nonlimiting, specific embodiments in accordance with the present disclosure:

Embodiment A

A system for servicing a subterranean formation comprising:

a wellbore completion string comprising:

a first master activatable stimulation assembly;

a first slave activatable stimulation assembly, wherein the first slave activatable stimulation assembly activates responsive to activation of the first master stimulation assembly;

a second master activatable stimulation assembly; and a second slave activatable stimulation assembly, wherein the second slave activatable stimulation assembly activates responsive to activation of the second master stimulation assembly.

Embodiment B

The system of Embodiment A, wherein activation of the first master activatable stimulation assembly provides a route of fluid communication via one or more ports of the first master activatable stimulation assembly from an interior flow path of the completion string to an area adjacent the port and exterior to the completion string, and wherein activation of the first slave activatable stimulation assembly provides a route of fluid communication via one or more ports of the first slave stimulation assembly from the interior flow path of the completion string to an area adjacent the port and exterior to the completion string.

Embodiment C

The system of one of Embodiments A through B, wherein activation of the second master activatable stimulation assembly provides a route of fluid communication via one or more ports of the second master activatable stimulation assembly from an interior flow path of the completion string to an area adjacent the port and exterior to the completion string, and wherein activation of the second slave activatable stimulation assembly provides a route of fluid communication via one or more ports of the second slave activatable stimulation assembly from the interior flow path of the completion string to an area adjacent the port and exterior to the completion string.

Embodiment D

The system of one of Embodiments A through C, wherein the first master activatable stimulation assembly comprises a seat configured to engage an obturating member.

Embodiment E

The system of one of Embodiments A through D, wherein the first master activatable stimulation assembly is configured to hydraulically activate the first slave activatable stimulation assembly.

Embodiment F

The system of one of Embodiments A through E, wherein the first master activatable stimulation assembly comprises a fluid reservoir having a variable internal volume.

Embodiment G

The system of Embodiment F, wherein the internal volume of the fluid reservoir of the first master activatable stimulation assembly is greater when the first master activatable stimulation assembly is not activated than the internal volume of the fluid reservoir of the first master activatable stimulation assembly when the first master activatable stimulation assembly is activated.

Embodiment H

The system of one of Embodiments F through G, wherein the first master activatable stimulation assembly further comprises:

a ported housing; and a sliding sleeve, wherein the housing and the sliding sleeve at least partially define the fluid reservoir of the first master activatable stimulation assembly.

Embodiment I

The system of one of Embodiments E through H, wherein the first slave activatable stimulation assembly comprises a fluid reservoir having a variable internal volume.

Embodiment J

The system of Embodiment I, wherein the internal volume of the fluid reservoir of the first slave activatable stimulation assembly is greater when the first slave activatable stimulation assembly is not activated than the internal volume of the fluid reservoir of the first slave activatable stimulation assembly when the first slave activatable stimulation assembly is not activated.

Embodiment K

The system of one of Embodiments I through J, wherein the first slave activatable stimulation assembly further comprises:

a ported housing; and a sliding sleeve, wherein the housing and the sliding sleeve at least partially define the fluid reservoir of the first slave activatable stimulation assembly.

Embodiment L

The system of one of Embodiments E through K, further comprising a hydraulic conduit extending between the first master activatable stimulation assembly and the first slave activatable stimulation assembly.

Embodiment M

A method of servicing a subterranean formation comprising:

positioning a wellbore completion string within the wellbore, wherein the wellbore completion string comprises:

a first master activatable stimulation assembly;

a first slave activatable stimulation assembly, wherein the first master stimulation assembly and the first slave activatable stimulation assembly are positioned substantially adjacent to a first subterranean formation zone;

a second master activatable stimulation assembly; and a second slave activatable stimulation assembly;

activating the first master activatable stimulation assembly, wherein the first slave activatable stimulation assembly is activated responsive to activating the first master activatable stimulation assembly; and communicating a stimulation fluid to the first subterranean formation zone via the first master activatable stimulation assembly and the first slave activatable stimulation assembly.

Embodiment N

The method of Embodiment M, wherein the second master stimulation assembly and the second slave activatable stimulation assembly are positioned substantially adjacent to a second subterranean formation zone.

Embodiment O

The method of Embodiment N, further comprising:

activating the second master activatable stimulation assembly, wherein the second slave activatable stimulation assembly is activated responsive to activating the second master activatable stimulation assembly; and communicating the stimulation fluid to the second subterranean formation zone via the second master activatable stimulation assembly and the second slave activatable stimulation assembly.

Embodiment P

The method of one of Embodiments N through O, wherein the first subterranean formation zone is downhole from the second subterranean formation zone.

Embodiment Q

The method of one of Embodiments M through P, wherein activating the first master activatable stimulation assembly comprises:

introducing an obturating member into the completion string; and passing the obturating member through the second slave activatable stimulation assembly, the second master activatable stimulation assembly; and the first slave activatable stimulation assembly to engage a seat within the first master activatable stimulation assembly.

Embodiment R

The method of one of Embodiments O through Q, wherein activating the second master activatable stimulation assembly comprises:

introducing an obturating member into the completion string; and passing the obturating member through the second slave activatable stimulation assembly to engage a seat within the second master activatable stimulation assembly.

Embodiment S

The method of one of Embodiments M through R, wherein the stimulation fluid comprises a fracturing fluid, a perforating fluid, an acidizing fluid, or combinations thereof.

Embodiment T

The method of one of Embodiments M through S, wherein the stimulation fluid is communicated at a rate and pressure to initiate a fracture within the first subterranean formation zone, extend a fracture within the first subterranean formation zone, or combinations thereof.

While embodiments of the invention have been shown and described, modifications thereof can be made by one skilled in the art without departing from the spirit and teachings of the invention. The embodiments described herein are exemplary only, and are not intended to be limiting. Many variations and modifications of the invention disclosed herein are possible and are within the scope of the invention. Where numerical ranges or limitations are expressly stated, such express ranges or limitations should be understood to include iterative ranges or limitations of like magnitude falling within the expressly stated ranges or limitations (e.g., from about 1 to about 10 includes, 2, 3, 4, etc.; greater than 0.10 includes 0.11, 0.12, 0.13, etc.). For example, whenever a numerical range with a lower limit, Rl, and an upper limit, Ru, is disclosed, any number falling within the range is specifically disclosed. In particular, the following numbers within the range are specifically disclosed: R=Rl+k*(Ru−Rl), wherein k is a variable ranging from 1 percent to 100 percent with a 1 percent increment, i.e., k is 1 percent, 2 percent, 3 percent, 4 percent, 5 percent, . . . 50 percent, 51 percent, 52 percent, . . . , 95 percent, 96 percent, 97 percent, 98 percent, 99 percent, or 100 percent. Moreover, any numerical range defined by two R numbers as defined in the above is also specifically disclosed. Use of the term "optionally" with respect to any element of a claim is intended to mean that the subject element is required, or alternatively, is not required. Both alternatives are intended to be within the scope of the claim. Use of broader terms such as comprises, includes, having, etc. should be understood to provide support for narrower terms such as consisting of, consisting essentially of, comprised substantially of, etc.

Accordingly, the scope of protection is not limited by the description set out above but is only limited by the claims which follow, that scope including all equivalents of the subject matter of the claims. Each and every claim is incorporated into the specification as an embodiment of the present invention. Thus, the claims are a further description and are an addition to the embodiments of the present invention. The discussion of a reference in the Detailed Description of the Embodiments is not an admission that it is prior art to the present invention, especially any reference that may have a publication date after the priority date of this application. The disclosures of all patents, patent applications, and publications cited herein are hereby incorporated by reference, to the extent that they provide exemplary, procedural or other details supplementary to those set forth herein.

What is claimed is:

1. A system for servicing a subterranean formation comprising:

a wellbore completion string comprising:

a first master activatable stimulation assembly comprising a first master sleeve, the first master sleeve having a first seat, wherein activation of the first master activatable stimulation assembly provides a first route of fluid communication via one or more ports of the first master activatable stimulation assembly from an interior flow path of the completion string to an area adjacent the one or more ports of the first master activatable stimulation assembly and exterior to the completion string;

a first slave activatable stimulation assembly comprising a first slave sleeve, wherein the first slave activatable stimulation assembly activates responsive to activation of the first master stimulation assembly, wherein activation of the first slave activatable stimulation assembly provides a second route of fluid communication via one or more ports of the first slave stimulation assembly from the interior flow path of the completion string to an area adjacent the one or more ports of the first slave stimulation assembly and exterior to the completion string;

a second master activatable stimulation assembly comprising a second master sleeve, the second master sleeve having a second seat; and a second slave activatable stimulation assembly comprising a second slave sleeve, wherein the second slave activatable stimulation assembly activates responsive to activation of the second master stimulation assembly.

2. The system of claim 1, wherein activation of the second master activatable stimulation assembly provides a third route of fluid communication via one or more ports of the second master activatable stimulation assembly from an interior flow path of the completion string to an area adjacent the one or more ports of the second master activatable stimulation assembly and exterior to the completion string, and wherein activation of the second slave activatable stimulation assembly provides a fourth route of fluid communication via one or more ports of the second slave activatable stimulation assembly from the interior flow path of the completion string to an area adjacent the one or more ports of the second slave activatable stimulation assembly and exterior to the completion string.

3. The system of claim 1, wherein the first seat is a seat configured to engage a first obturating member having a first configuration, and wherein the second seat is configured to engage a second obturating member having a second configuration.

4. The system of claim 1, wherein the first master activatable stimulation assembly is configured to hydraulically activate the first slave activatable stimulation assembly.

5. The system of claim 4, wherein the first master activatable stimulation assembly comprises a fluid reservoir having a variable internal volume.

6. The system of claim 5, wherein the internal volume of the fluid reservoir of the first master activatable stimulation assembly is greater when the first master activatable stimulation assembly is not activated than the internal volume of the fluid reservoir of the first master activatable stimulation assembly when the first master activatable stimulation assembly is activated.

7. The system of claim 5, wherein the first master activatable stimulation assembly further comprises:

a housing comprising the one or more ports of the first master activatable stimulation assembly;

wherein the housing and the first master sleeve at least partially define the fluid reservoir of the first master activatable stimulation assembly.

8. The system of claim 4, wherein the first slave activatable stimulation assembly comprises a fluid reservoir having a variable internal volume.

9. The system of claim 8, wherein the internal volume of the fluid reservoir of the first slave activatable stimulation assembly is greater when the first slave activatable stimulation assembly is activated than the internal volume of the fluid reservoir of the first slave activatable stimulation assembly when the first slave activatable stimulation assembly is not activated.

10. The system of claim 8, wherein the first slave activatable stimulation assembly further comprises:

a housing comprising the one or more ports of the first slave stimulation assembly;

wherein the housing and the first master sleeve at least partially define the fluid reservoir of the first slave activatable stimulation assembly.

11. The system of claim 4, further comprising a hydraulic conduit extending between the first master activatable stimulation assembly and the first slave activatable stimulation assembly.

12. A method of servicing a subterranean formation comprising:

positioning a wellbore completion string within the wellbore, wherein the wellbore completion string comprises:

a first master activatable stimulation assembly comprising a first master sleeve, the first master sleeve having a first seat;

a first slave activatable stimulation assembly comprising a first slave sleeve, wherein the first master stimulation assembly and the first slave activatable stimulation assembly are positioned substantially adjacent to a first subterranean formation zone;

a second master activatable stimulation assembly comprising a second master sleeve, the second master sleeve having a second seat; and a second slave activatable stimulation assembly comprising a second slave sleeve;

activating the first master activatable stimulation assembly, wherein activating the first master activatable stimulation assembly comprises: passing a first obturating member through the wellbore completion string to engage the first seat; and applying a force to the first master sleeve via the first obturating member, wherein activation of the first master activatable stimulation assembly provides a first route of fluid communication via one or more ports of the first master activatable stimulation assembly from an interior flow path of the completion string to an area adjacent the one or more ports of the first master activatable stimulation assembly and exterior to the completion string, wherein the first slave activatable stimulation assembly is activated responsive to activating the first master activatable stimulation assembly, wherein activation of the first slave activatable stimulation assembly provides a second route of fluid communication via one or more ports of the first slave stimulation assembly from the interior flow path of the completion string to an area adjacent the one or more ports of the first slave stimulation assembly and exterior to the completion string; and communication a stimulation fluid to the first subterranean formation zone via the first route of fluid communication and the second route of fluid communication.

13. The method of claim 12, wherein the second master stimulation assembly and the second slave activatable stimulation assembly are positioned substantially adjacent to a second subterranean formation zone.

14. The method of claim 13, further comprising:

activating the second master activatable stimulation assembly, wherein activating the second master activatable stimulation assembly comprises: passing a second obturating member through the wellbore completion string to engage the first seat; and applying a force to the second master sleeve via the second obturating member, wherein activation of the second master activatable stimulation assembly provides a third route of fluid communication via one or more ports of the second master activatable stimulation assembly from an interior flow path of the completion string to an area adjacent the one or more ports of the second master activatable stimulation assembly and exterior to the completion string, wherein the second slave activatable stimulation assembly is activated responsive to activating the second master activatable stimulation assembly, wherein activation of the second slave activatable stimulation assembly provides a fourth route of fluid communication via one or more ports of the second slave stimulation assembly from the interior flow path of the completion string to an area adjacent the one or more ports of the second slave stimulation assembly and exterior to the completion string; and communicating the stimulation fluid to the second subterranean formation zone via the third route of fluid communication and the fourth route of fluid communication.

15. The method of claim 14, wherein the first subterranean formation zone is downhole from the second subterranean formation zone.

16. The method of claim 12, wherein passing a first obturating member through the wellbore completion string comprises;

introducing the first obturating member into the completion string; and passing the first obturating member through the second slave activatable stimulation assembly, the second master activatable stimulation assembly passing a second obturating member through the wellbore completion string and the first slave activatable stimulation assembly.

17. The method of claim 14, wherein the second comprises:

introducing the second obturating member into the completion string; and passing the second obturating member through the second slave activatable stimulation assembly.

18. The method of claim 12, wherein the stimulation fluid comprises a fracturing fluid, a perforating fluid, an acidizing fluid, or combinations thereof.

19. The method of claim 12, wherein the stimulation fluid is communicated at a rate and pressure to initiate a fracture within the first subterranean formation zone, extend a fracture within the first subterranean formation zone, or combinations thereof.

20. The method of claim 14, wherein the first master activatable stimulation assembly is configured to hydraulically activate the first slave activatable stimulation assembly, wherein the first master activatable stimulation assembly comprises a fluid reservoir having a variable internal volume, wherein the internal volume of the fluid reservoir of the first master activatable stimulation assembly is greater when the first master activatable stimulation assembly is not activated than the internal volume of the fluid reservoir of the first master activatable stimulation assembly when the first master activatable stimulation assembly is activated, and wherein the first slave activatable stimulation assembly comprises a fluid reservoir having a variable internal volume, wherein the internal volume of the fluid reservoir of the first slave activatable stimulation assembly is greater when the first slave activatable stimulation assembly is activated than the internal volume of the fluid reservoir of the first slave activatable stimulation assembly when the first slave activatable stimulation assembly is not activated.

* * * * *